US007404827B2

(12) United States Patent
Ishikawa et al.

(10) Patent No.: US 7,404,827 B2
(45) Date of Patent: Jul. 29, 2008

(54) FABRIC TREATING AGENT COMPOSITION

(75) Inventors: Akira Ishikawa, Wakayama (JP); Masahito Chiwaki, Wakayama (JP); Motoko Fujii, Wakayama (JP); Akira Fujiu, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/567,327

(22) PCT Filed: Aug. 4, 2004

(86) PCT No.: PCT/JP2004/011519

§ 371 (c)(1),
(2), (4) Date: Jul. 7, 2006

(87) PCT Pub. No.: WO2005/014921

PCT Pub. Date: Feb. 17, 2005

(65) Prior Publication Data

US 2006/0277688 A1 Dec. 14, 2006

(30) Foreign Application Priority Data

Aug. 8, 2003 (JP) ..... 2003-290742
Jan. 28, 2004 (JP) ..... 2004-019513

(51) Int. Cl.
*D06M 10/00* (2006.01)

(52) U.S. Cl. ..... 8/115.51; 8/115.55; 424/70.12; 510/130; 510/287; 510/405; 510/516; 510/522; 422/5; 556/440

(58) Field of Classification Search ..... 510/522, 510/130, 516, 287, 405; 8/115.51, 115.55; 252/8.91; 424/70.12; 422/5; 556/440
See application file for complete search history.

(56) References Cited

U.S. PATENT DOCUMENTS

| | | | | |
|---|---|---|---|---|
| 3,414,604 | A * | 12/1968 | Pepe et al. | 556/440 |
| 4,800,026 | A * | 1/1989 | Coffindaffer et al. | 510/516 |
| 5,035,832 | A * | 7/1991 | Takamura et al. | 510/405 |
| 6,022,845 | A * | 2/2000 | Avila-Garcia et al. | 510/522 |
| 6,472,355 | B2 * | 10/2002 | Elliott et al. | 510/130 |
| 6,790,819 | B2 * | 9/2004 | Trinh et al. | 510/287 |
| 7,052,681 | B2 * | 5/2006 | Ferrari | 424/64 |
| 2002/0011584 | A1 * | 1/2002 | Uchiyama et al. | 252/8.91 |
| 2002/0058129 | A1 * | 5/2002 | Idehara et al. | 428/195 |
| 2002/0131947 | A1 * | 9/2002 | Nakanishi | 424/70.12 |
| 2002/0159964 | A1 * | 10/2002 | Nakanishi et al. | 424/70.12 |
| 2003/0035748 | A1 * | 2/2003 | Trinh et al. | 422/5 |

FOREIGN PATENT DOCUMENTS

| | | | |
|---|---|---|---|
| EP | 1 076 129 | A2 | 2/2001 |
| JP | 8-209543 | A | 8/1996 |
| JP | 10-131054 | A | 5/1998 |
| JP | 10-195772 | A | 7/1998 |
| JP | 11-343402 | A | 12/1999 |
| JP | 2000-64179 | A | 2/2000 |
| JP | 2000-110068 | A | 4/2000 |
| JP | 2000-110077 | A | 4/2000 |
| JP | 2000-129577 | A | 5/2000 |
| JP | 2000-129578 | A | 5/2000 |
| JP | 2000-239970 | A | 9/2000 |
| JP | 2001-49582 | A | 2/2001 |
| JP | 2001-172878 | A | 6/2001 |
| JP | 2001-192973 | A | 7/2001 |
| JP | 2002-80603 | A | 3/2002 |
| JP | 2002-371474 | A | 12/2002 |

* cited by examiner

*Primary Examiner*—Mark Kopec
*Assistant Examiner*—Khanh Tuan Nguyen
(74) *Attorney, Agent, or Firm*—Birch, Stewart, Kolasch & Birch, LLP

(57) ABSTRACT

The present invention relates to a fiber product treating agent composition containing (a) a nonionic surfactant containing 1 to 3 polyoxyalkylene groups having the number-average addition mol number of the oxyalkylene group of 50 to 200 and 1 to 3 hydrocarbon groups having 14 to 32 carbon atoms and having an HLB of 16 or more and a melting point of 30 to 80° C., and (b) an amino-modified silicone compound in a mass ratio of the component (a)/the component (b) of 4/1 to 1/4.

22 Claims, No Drawings

FABRIC TREATING AGENT COMPOSITION

FIELD OF THE INVENTION

The present invention relates to a fiber product treating agent composition.

BACKGROUND OF THE INVENTION

Softeners and sizing agents are typified as fiber product treating agents for general domestic use. The softeners serve to soften fiber products such as clothes to make these fiber products have soft and comfortable finish. The sizing agents serve to give tenseness to fiber products to make these fiber products have comfortable feel near to that of new products to the touch. These softeners and sizing agents are each used in proper way according to user's preferences and the type of fiber product to be applied. However, there is a current tendency that finished feel obtained by a softener is preferred to that obtained by a sizing agent and the demand for sizing agents tend to be decreased year by year. This is considered to be because there is a tendency not to prefer rough feel and starchy feel obtained by a sizing agent. On the other hand, there is a present situation where the preference of users cannot be satisfied by only the soft finish obtained by a softener for the diversified types of clothes. In view of this situation, there is a strong demand for a treating agent that gives fiber products a finished feel to the touch which has not been accomplished by a softener or sizing agent alone, specifically, such finished feel as tensile feel, no starchy feel and smooth feel to the touch.

Also, another reason why the sizing agent is not preferred is that it requires a lot of time and effort for treatment. In the use of a conventional sizing agent, it is preferred to sort fiber products into those treated with a sizing agent and those treated without a sizing agent during a washing process and time and effort are required for the sorting. Also, usual sizing agent bases are all film-formable, and when an automatic charge port of a washing machine is used, a high-molecular compound of the sizing agent base adheres to the charge port and significantly spoils the appearance of the washing machine. Therefore, it is general to avoid the use of the automatic charge port. When a user charges a sizing agent, it is necessary that he charges it by hand and chooses the timing of charge, which requires considerable time and effort. It is therefore desired to develop a treating agent that requires no sorting operation and permits the use of the automatic charge port without any particular problem.

Moreover, when clothes such as shirts and polo-shirts are washed, washing wrinkles are formed through washing/rinsing/dewatering/drying and in the case of particularly, clothes containing cellulose type fibers such as cotton, wrinkles are formed to the extent that these clothes cannot be worn if omitting the pressing of these wrinkled clothes. Also, a shirt or the like that has been treated to stabilize its shape has been recently spread. However, these products lose its shape-stabilizing effect when they are worn/washed repeatedly and therefore do not reach the stage in which ironing is omitted. However, because this ironing is among troublesome housework, there is a strong desire to develop a method making it possible to remove wrinkles simply to the extent that clothes can be worn without ironing.

The inventors of the present invention disclosed treating agents that contain a water-soluble high-molecular compound, a silicone compound and a nonionic surfactant and restore the original shape and feel of clothes in Japanese Patent Application Laid-Open (JP-A) Nos. 2000-129577, 2000-129578 and 2000-239970.

Also, fiber product treating agents containing a quaternary ammonium compound, a silicone compound and a nonionic surfactant as softener components are disclosed in JP-A Nos. 2000-64179, 2000-110068, 2000-110077, 2001-172878 and 2002-371474.

Besides the above prior art, JP-A Nos. 2001-49582, 2001-192973, 2002-80603, 8-209543, 10-131054 and 11-343402 disclose technologies using a nonionic surfactant as an emulsifier of a silicone compound.

SUMMARY OF THE INVENTION

The present invention provides a fiber product treating agent composition containing a silicon compound having (a) a nonionic surfactant containing 1 to 3 polyoxyalkylene groups having the number-average addition mol number of the oxyalkylene group of 50 to 200 and 1 to 3 hydrocarbon groups having 14 to 32 carbon atoms and having an HLB of 16 or more and a melting point of 30 to 80° C., and (b) an amino-modified silicone compound in a mass ratio of the component (a)/the component (b) of 4/1 to 1/4, and a fiber product treating agent composition further containing (c) at least one type selected from a tertiary amine in which one or two groups among the three groups bonded with a nitrogen atom are a hydrocarbon group having 10 to 20 carbon atoms and the remainder groups are a hydrocarbon group which has 1 to 3 carbon atoms and may be substituted with a hydroxy group, an acid salt thereof and a quaternary product thereof in a mass ratio of the component (a)/the component (c) of 20/1 to 1/1.

The present invention provides a fiber product treating agent composition containing (a) a nonionic surfactant containing 1 to 3 polyoxyalkylene groups having the number-average addition mol number of the oxyalkylene group of 50 to 200 and 1 to 3 hydrocarbon groups having 14 to 32 carbon atoms and having an HLB of 16 or more and a melting point of 30 to 80° C., (b) an amino-modified silicone compound and (m) a silicone compound having a polyoxyalkylene chain.

The present invention provides use of the above composition for a fiber product treating agent and a method of treating a fiber product by using the above composition.

DETAILED DESCRIPTION OF THE INVENTION

Also, the technologies disclosed in JP-A Nos. 2000-64179, 2000-110068, 2000-110077, 2001-172878 and 2002-371474 use a nonionic surfactant as a stabilizer or a gelling preventive, and are not intended to disclose such a method in which a specific nonionic surfactant produces the effects of imparting moderate tenseness and comfortable feel to the touch to clothes nor suppressing the formation of wrinkles.

The present invention provides a fiber product treating agent composition that requires no manual sorting operation, permits the use of the automatic charge port, imparts moderate tenseness and comfortable feel to the touch to clothes and suppresses the formation of wrinkles. The present invention also provides a fiber product treating agent composition that can further impart water absorbing property to clothes.

The fiber product treating agent composition requires no sorting operation in a washing process, can be applied to the automatic charge port, imparts moderate tenseness and comfortable feel to the touch to clothes and suppresses the formation of wrinkles. The fiber product treating agent composition of the present invention can further impart water absorbing property to clothes.

The component (a) used in the present invention is a nonionic surfactant containing 1 to 3, preferably 1 or 2 and particularly preferably 1 polyoxyalkylene group(s) in which the number-average addition mol number of the oxyalkylene group is 50 to 200, preferably 70 to 180, particularly preferably 90 to 160, (the alkylene group is preferably an alkylene group having 2 to 4 carbon atoms, more preferably an ethylene group or a propylene group and particularly preferably an ethylene group), 1 to 3, preferably 1 or 2 and particularly preferably 1 hydrocarbon group(s) having 14 to 32, preferably 16 to 24 and particularly preferably 16 to 18 carbon groups, an HLB of 16 or more, preferably 17 to 19.8 and particularly preferably 18 to 19.6 and a melting point of 30 to 80° C., preferably 40 to 75° C. and particularly preferably 50 to 70° C.

In the present invention, the above HLB is the one calculated by the Griffin method and the melting point is measured by the following method.

Method of Measuring a Melting Point 0.5 g of a sample is placed in a 10 mL of glass screw tube (No. 3, 21 mm×45 mm) (five tubes for each sample) and sealed hermetically with a lid under atmospheric pressure. Each sample is divided into five lots, which are poured into five tubes respectively, and these tubes are stored in 30° C., 40° C., 50° C., 60° C. and 70° C. thermostatic chambers such that the lid faces upward to observe the state of the sample in each tube after 24 hours. The sample put into a completely transparent liquid state is judged to have a melting point above the store temperature, thereby determining the range of the melting point in each sample. Next, a temperature-controllable water bath is prepared and each tube containing the sample that is stored in advance in a 5° C. thermostatic chamber for 24 hours is immersed up to a height more than half the height of the tube from the bottom in a hermetically sealed state. The temperature of the water bath is raised at a rate of 1° C./30 min. from a temperature lower by 5° C. than the lower limit of an expected temperature range. The temperature at which the sample becomes transparent is determined as the melting point of the sample.

Generally, sizing agents imparting tenseness to fiber products such as clothes use, as a sizing agent base, processed starch or a water-soluble cellulose derivative as described in JP-A No. 2000-129577 or a water-soluble high-molecular compound as described in JP-A No. 2000-129578. However, in the case of using these compounds, they give unacceptable feel such as starchy feel to fibers while imparting excellent tenseness. In the present invention, the component (a) is used in place of such a sizing agent base in combination with the component (b), which makes it possible to impart moderate tenseness and excellent feel to fiber products. Nonionic surfactants are usually used as a stabilizer or gelling preventive for fiber product treating agents and it is not obvious to even a person skilled in the art to use the component (a) as a sizing agent base as used in the present invention.

Specific examples of the component (a) may include compounds represented by the formula (1).

$$R^{1a}\text{-A-}[(R^{1b}\text{—O})_a\text{—}R^{1c}]_b \quad (1)$$

In the formula, $R^{1a}$ represents an alkyl or alkenyl group having 14 to 32, preferably 16 to 24 and particularly preferably 16 to 18 carbon atoms and $R^{1b}$ represents an alkylene group having 2 or 3 carbon atoms. $R^{1c}$ represents a group selected from a hydrogen atom, an alkyl or alkenyl group having 14 to 32, preferably 16 to 24 and particularly preferably 16 to 18 carbon atoms and an alkanoyl or alkenoyl group (preferably an alkanoyl group) having 15 to 33, preferably 17 to 25 and particularly preferably 17 to 19 carbon atoms. A represents a connecting group selected from —O—, —COO—, —CON< or —N<, provided that when A is —O— or —COO—, b is 1 and when A is —CON< or —N<, b is 2. a is a number-average value of 50 to 200, preferably 70 to 180 and particularly preferably 90 to 160. Here, plural $R^{1b}$s and $R^{1c}$s may be the same or different.

In the formula (1), $R^{1a}$ is even more preferably an alkyl group having 16 to 18 carbon atoms, $R^{1b}$ is even more preferably an ethylene group and $R^{1c}$ is even more preferably a hydrogen atom. Also, A is preferably —O— or —COO— and even more preferably —O—.

As the component (a), particularly a compound represented by the formula (2) is even more preferable.

$$R^{1a}\text{—O—}(C_2H_4O)_a\text{—H} \quad (2)$$

In the formula, $R^{1a}$ and a have the same meaning as described above.

In the present invention, the component (a) acts as the sizing agent base. When the component (a) is used alone, it more suppresses starchy feel than a water-soluble high-molecular compound, which is generally used for the sizing agent base. However, this does not reach a satisfactory level, an amino-modified silicone compound is combined as the component (b) in the present invention. The component (b) has an important role giving the effect of more suppressing starchy feel, imparting moderate smoothness to fiber products and suppressing the formation of wrinkles.

As the component (b), amino-modified silicone compounds as described in each publication of JP-A Nos. 2001-49582, 2001-192973, 2002-371474, 8-325952 and 10-131054. The component (b) is an amino-modified silicone compound having a kinematic viscosity (may be found by an Ostwald-type viscometer) of preferably 100 to 20000 $mm^2/s$, more preferably 200 to 10000 $mm^2/s$ and particularly preferably 500 to 5000 $mm^2/s$ at 25° C. and an amino equivalent (molecular weight per nitrogen atom, found by the formula: amino equivalent=molecular weight/number of N atoms, wherein the molecular weight is a value found by gel permeation chromatography based on polystyrene and the number of nitrogen atoms may be found by an elemental analysis method) of preferably 400 to 8000, more preferably 600 to 5000 and particularly preferably 800 to 30000.

Specific examples of the component (b) include compounds represented by the formula (3).

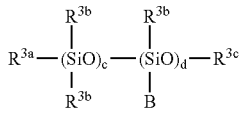

(3)

In the formula, $R^{3a}$ represents an alkyl group having 1 to 3 carbon atoms, a hydroxy group, —$OR^{3d}$ (where $R^{3d}$ represents an alkyl group having 1 to 3 carbon atoms) or a hydrogen atom and $R^{3b}$ represents an alkyl group having 1 to 3 carbon atoms, a hydroxy group or a hydrogen atom. B represents a side chain having at least one amino group and $R^{3c}$ represents an alkyl group having 1 to 3 carbon atoms or a hydrogen atom. c and d denote a number of 10 to 10,000 and a number of 1 to 1,000, respectively, and are a number so designed that the weight-average molecular weight of the compound represented by the formula (3) may be 2,000 to 1,000,000. $R^{3a}$, $R^{3b}$, $R^{3c}$ and $R^{3d}$ may be the same as or different from one another and plural $R^{3b}$s may be the same as or different from one another.

In the formula (3), $R^{3a}$ is preferably a methyl group or a hydroxy group, $R^{3b}$ is preferably a methyl group or a hydroxy group, $R^{3c}$ is preferably a methyl group or a hydrogen atom and $R^{3d}$ is preferably a methyl group. The weight-average molecular weight of the compound is preferably 5,000 to 100,000 and particularly preferably 8,000 to 50,000. Here, the weight-average molecular weight may be found by gel permeation chromatography based on polystyrene. Examples of the side chain B having an amino group include the following compounds.

$—C_3H_6—NH_2$ $—C_3H_6—NH—C_2H_4—NH_2$ $—C_3H_6—NH—[C_2H_4—NH]_e—C_2H_4—NH_2$ $—C_3H_6—NH(CH_3)$ $—C_3H_6—NH—C_2H_4—NH(CH_3)$ $—C_3H_6—NH—[C_2H_4—NH]_f—C_2H_4—NH(CH_3)$ $—C_3H_6—N(CH_3)_2$ $—C_3H_6—N(CH_3)—C_2H_4—N(CH_3)_2$ $—C_3H_6—N(CH_3)—[C_2H_4—N(CH_3)]_g—C_2H_4—N(CH_3)_2$ $—C_3H_6—NH\text{-cyclo-}C_5H_{11}$ Here, e, f and g respectively denote a number of 1 to 30.

The component (b) in the present invention may be produced in the following manner: a hydrolysate obtained by hydrolyzing an organoalkoxysilane represented by the following formula (5) by excess water and dimethylcyclopolysiloxane are heated at 80 to 110° C. in the presence of a basic catalyst such as sodium hydroxide to run an equilibrium reaction and when the viscosity of the reaction mixture reaches a desired one, the basic catalyst is neutralized using an acid (JP-A No. 53-98499).

$$H_2N(CH_2)_2NH(CH_2)_3Si(CH_3)(OCH_3)_2 \quad (5)$$

As the component (b) in the present invention, the oily one may be compounded as it is with no problem. However, it is preferable to compound the component (b) in the form of an aqueous emulsion in which particles of the component (b) are dispersed in water in the point that the composition of the present invention can be produced easily. In the aqueous emulsion used as the component (b), a surfactant is preferably used as an emulsifier. As the surfactant, anionic surfactants such as an alkylbenzenesulfonic acid or its salt, alkyl sulfate, polyoxyalkylene alkyl ether sulfate, olefin sulfonate, alkane sulfonate and aliphatic acid salt, nonionic surfactants which are not included in the component (a) such as a polyoxyalkylene alkyl or alkenyl ether, polyoxyalkylene alkylphenyl ether, fatty acid alkanolamide or its alkylene oxide adduct, cane sugar fatty acid ester and alkyl glycoside, amphoteric surfactants such as amine oxide, sulfobetaine and carbobetaine and cationic surfactants such as a tri-long-chain alkyl quaternary ammonium salt may be used. In this case, it is necessary that the effect of the component (c) in the present invention is not impaired in the case of using an anionic surfactant and therefore, the compounding molar ratio of the anionic surfactant to the component (c) is designed to be less than 1 and particularly preferably less than 0.5.

The average particle diameter of the emulsion particles in an aqueous emulsion of the component (b) is preferably 0.01 to 10 μm, more preferably 0.01 to 5 μm and particularly preferably 0.01 to 10 μm from the viewpoint of obtaining acceptable feel. Although as the emulsifier of the aqueous emulsion of the component (b), a nonionic surfactant corresponding to the component (a) may be used, the total amount of the component (a) In the composition of the present invention must be designed such that the ratio of the component (a)/the component (b) is 4/1 to 1/4 by mass.

Examples of materials to be used as the component (b) may include TSF4703 (viscosity: 1000 $mm^2/s$ (25° C.), amino equivalent: 1600), TSF4707 (viscosity: 10000 $mm^2/s$ (25° C.), amino equivalent: 7000) and TSF4708 (viscosity: 1000 $mm^2/s$ (25° C.), amino equivalent: 2800) manufactured by GE-Toshiba Silicone, SS-3551 (viscosity: 1000 $mm^2/s$ (25° C.), amino equivalent: 1600), SS-3552 (viscosity: 700 $mm^2/s$ (25° C.), amino equivalent: 7000), FZ-3705 (viscosity: 250 $mm^2/s$ (25° C.), amino equivalent: 4000) and FZ-319 (viscosity: 2000 $mm^2/s$ (25° C.), amino equivalent: 4000) manufactured by Nippon Unicar Company Limited), SF8451C (viscosity: 600 $mm^2/s$ (25° C.), amino equivalent: 1700), SF8452C (viscosity: 700 $mm^2/s$ (25° C.), amino equivalent: 6400), SF8457C (viscosity: 1200 $mm^2/s$ (25° C.), amino equivalent: 1800), SF8417 (viscosity: 1200 $mm^2/s$ (25° C.), amino equivalent: 1800) BY16-849 (viscosity: 1300 $mm^2/s$ (25° C.), amino equivalent: 600), BY16-850 (viscosity: 1100 $mm^2/s$ (25° C.), amino equivalent: 1100), BY16-892 (viscosity: 1000 $mm^2/s$ (25° C.), amino equivalent: 2000), BY16-879B (viscosity: 1190 $mm^2/s$ (25° C.), amino equivalent: 8000) and BY16-872 (viscosity: 20000 $mm^2/s$ (25° C.), amino equivalent: 1800) manufactured by Dow Corning Toray Silicone Co., Ltd., KF857, KF858, KF859, KF862, KF8001 and KF880 manufactured by Shin-Etsu Chemical Co., Ltd., and WR300 (viscosity: 600 $mm^2/s$ (25° C.), amino equivalent: 3300), WR1100 (viscosity: 5000 $mm^2/s$ (25° C.), amino equivalent: 7000), WR1600 (viscosity: 1000 $mm^2/s$ (25° C.), amino equivalent: 1700) and WT1650 (viscosity: 1000 $mm^2/s$ (25° C.), amino equivalent: 1700) manufactured by Asahi Kasei Wacker Silicone (k.k.).

As the aqueous emulsion of the component (b), which may be used, in the present invention, one obtained by dispersing the aforementioned oily material of the component (a) in water by using an emulsifier such as a surfactant and various emulsifiers (e.g., a homomixer, high pressure homogenizer and colloid mill) may be used. Also, an emulsion containing a desired amino-modified silicone may be prepared by running a polymerization reaction using an organoalkoxysilane, dimethylcyclopolysiloxane and the like in water and used as the aqueous emulsion of the component (b) as its is. Specific examples of the aqueous emulsion of the component (B) may include FZ-4632, FZ-4635, FZ-4640, FZ-4645 or FZ-4658 manufactured by Nippon Unicar Company Limited), SM8702, SM8704C, SM8709, BY22-812, BY22-816, BY22-819 and BY22-823 manufactured by Dow Corning Toray Silicone Co., Ltd., and Polon MF-14, Polon MF-14D, Polon MF-14EC, Polon MF-29, Polon MF-39, Polon MF-44 and Polon MF-52 manufactured by Shin-Etsu Chemical Co., Ltd.

When as the component (b), a compound represented by the following formula (7) is used, it cannot only impart tenseness, smoothness and wrinkle-reducing effect to fibers but also suppress a deterioration in hue when the fiber product treating agent composition of patent application of this case is stored. As the component (b), a compound represented by the following formula (7) is preferable.

(7)

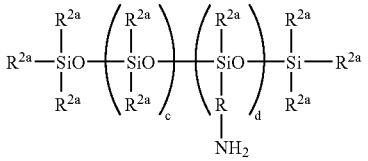

In the formula, $R^{2a}$ is a group selected from alkyl groups having 1 to 3 carbon atoms, a hydroxy group and alkyloxy groups having 1 to 3 carbon atoms and is preferably a methyl group and R represents an alkylene group having 1 to 5 carbon atoms and is preferably an ethylene group or a propylene group and particularly preferably a propylene group. c and d respectively denote an average polymerization degree, and is selected such that the compound has a kinematic viscosity (may be found by an Ostwald-type viscometer) of preferably 100 to 20000 $mm^2/s$, more preferably 200 to 10000 $mm^2/s$ and particularly preferably 500 to 5000 $mm^2/s$ at 25° C. and an amino equivalent (molecular weight per nitrogen atom, found by the formula: amino equivalent=molecular weight/the number of N atoms, wherein the molecular weight is a value found by gel permeation chromatography based on polystyrene and the number of nitrogen atoms may be found by an elemental analysis method) of preferably 400 to 8000, more preferably 600 to 5000 and particularly preferably 800 to 30000.

In the compound represented by the formula (7), c is a number of 10 to 10,000, preferably 20 to 5,000 and more preferably 30 to 3,000, d is a number of 1 to 1,000, preferably 1 to 500 and more preferably 1 to 200 and the weight-average molecular weight is preferably 2,000 to 1,000,000, more preferably 5,000 to 100,000 and particularly preferably 8,000 to 50,000. Here, the weight-average molecular weight may be found by gel permeation chromatography based on polystyrene.

Examples of the compound of the formula (7) may include amino-modified silicone KF-864 (viscosity: 1700 $mm^2/s$ (25° C.), amino equivalent: 3800), KF-865 (viscosity: 110 $mm^2/S$ (25° C.), amino equivalent: 5000), KF-868 (viscosity: 90 $mm^2/s$ (25° C.), amino equivalent: 8800) and KF-8003 (viscosity: 1850 $mm^2/s$ (25° C.), amino equivalent: 2000) and amino-modified silicone DC2-8630 (viscosity: 1500 $mm^2/s$ (25° C.), amino equivalent: 4300) manufactured by Dow Corning Toray Silicone Co., Ltd.

The composition of the present invention can impart moderate tenseness and preferable feel to fiber products when it is compounded of the above components (a) and (b) in a mass ratio of 4/1 to 1/4.

Specific care must be taken when softeners and sizing agent bases that are usually used are compounded together in the composition of the present invention because these materials impair the tenseness and feel of fibers, which will be improved by the effects of the present invention. When at least one type (component (c)), which is known as a general softener, and selected from a tertiary amine in which one or two groups among the three groups bonded with a nitrogen atom are respectively a hydrocarbon group having 10 to 20 carbon atoms and the remainder groups are respectively a hydrocarbon group which has 1 to 3 carbon atoms and may be substituted with a hydroxy group, its acid salt and quaternary product, is used in a small amount in the present invention, the adsorption of the component (a) to fiber products is promoted and smoother feel to the touch is obtained. However, if the component (c) is used excessively, the tenseness, which is the feature of the present invention, is not exhibited and the characteristics of a softener are intensified. Therefore, the ratio ((a)/(c), by mass) of the component (a) to the component (c) is 20/1 to 1/1.

Specific and preferable examples of the component (c) in the present invention include a tertiary amine represented by the formula (4) or its acid salt or quaternary products.

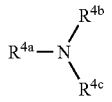

(4)

In the formula, $R^{4a}$ represents a hydrocarbon group having 10 to 20 carbon atoms, $R^{4b}$ represents a hydrocarbon group having 10 to 20 carbon atoms or a hydrocarbon group which has 1 to 3 carbon atoms and may be substituted with a hydroxy group and $R^{4c}$ represents a hydrocarbon group which has 1 to 3 carbon atoms and may be substituted with a hydroxy group.

In the formula (4), $R^{4a}$ is preferably an alkyl group and/or an alkenyl group having 10 to 20 carbon atoms and particularly preferably an alkyl group having 12 to 18 carbon atoms, $R^{4b}$ is preferably an alkyl group and/or an alkenyl group having 10 to 20 carbon atoms, particularly preferably an alkyl group having 12 to 18 carbon atoms or an alkyl group having 1 to 3 carbon atoms and particularly a methyl group. $R^{4c}$ is preferably an alkyl group having 1 to 3 carbon atoms and particularly a methyl group. Examples of the acid salts of the tertiary amine include salts of inorganic acids such as hydrochloric acid, nitric acid, phosphoric acid or sulfuric acid and salts of organic acids such as acetic acid, lactic acid, glycolic acid, citric acid, succinic acid or maleic acid. Also, examples of the above quaternary products of the tertiary amine include those formed using an alkyl halide, such as methyl chloride, having 1 to 4 carbon atoms or a dialkyl sulfate having 2 to 6 carbon atoms.

Most of general sizing agent bases are provided in the form of an aqueous solution or an aqueous dispersion solution and are high-molecular compounds superior in film forming ability when dried at normal temperature. This film forming ability when dried at normal temperature is a cause of starchy feel of a sizing agent and is the property, which must be evaded, in the present invention. Specifically, a high-molecular compound (hereinafter referred to as a component (d1)) superior in film forming ability when dried at a normal temperature of (25° C.) among high-molecular compounds (hereinafter referred to as a component (d)) which do not correspond to the components (a) and (b) may be used in a small amount for the purpose of improving storage stability and for rheology control. However, it is necessary to limit the content of the component (d1) to a lower level. Therefore, the ratio ([(a)+(b)]/(d1) (mass ratio) of "the total content of the components (a) and (b)" to the component (d1) in the composition of the present invention is preferably 100/0 to 80/20, more preferably 100/0 to 90/10 and particularly preferably 100/0 to 95/5. On the other hand, a high-molecular compound (hereinafter referred to as a component (d2)) which forms little film when dried at normal temperature (25° C.) among the component (d) may be used in a small amount without any problem and may be used to the extent that the effect of the present invention is not adversely affected. However, it is preferred to use a lower content of the component (d2) than the component (a). Therefore, the ratio ([(a)+(b)]/(d2) (mass ratio) of "the total content of the components (a) and (b)" to the component (d2) in the composition of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) is preferably 95/5 to 60/40, more preferably 95/5 to 70/30 and particularly preferably 95/5 to 80/20.

The high-molecular compound called in the present invention is a compound having a weight-average molecular weight of 2000 or more. With regard to a method of measuring the molecular weight, it can be found by gel permeation chromatography based on polyethylene glycol in the case where the high-molecular compound is soluble in water or based on polystyrene in the case where the high-molecular compound is insoluble in water.

Any material may be used as the component (d1) without any particular limitation insofar as it is a high-molecular compound superior in film forming ability when dried at normal temperature. Examples of the component (d1) include carboxymethyl cellulose, carboxyethyl cellulose, hydroxyethyl cellulose, hydroxypropyl cellulose, methyl cellulose, ethyl cellulose, sodium carboxymethyl cellulose, cationic cellulose, polyvinyl alcohol, polyvinyl alcohol maleic acid copolymer, polymethylmethacrylic acid, polyacrylic acid, sodium polyacrylate, a copolymer of vinyl acetate and acrylic acid, a copolymer of vinyl acetate and methacrylic acid, a copolymer of vinyl acetate and maleic acid, sodium polystyrenesulfonate, polyvinylpyrrolidone, polyacrylamide, water-soluble nylon, polyethylene oxide (weight-average molecular weight: 100000 or more), alginic acid, sodium alginate, cornstarch, amylose, dextrin, wheat starch, potato starch, tapioca starch, alpha-starch, acid-treated starch, starch oxide, starch acetate, carboxymethyl starch, carboxyethyl starch, hydroxyethyl starch, hydroxypropyl starch, starch phosphate, cationic starch, amphoteric starch, dialdehyde starch, crosslinked starch, starch organic acid ester, starch inorganic acid ester, pluran, xanthane gum and deacetylated xanthane gum.

Any material may be used as the component (d2) insofar as it is a high-molecular compound that forms little film when dried at normal temperature. Examples of the component (d2) include polyethylene glycol, polypropylene glycol or a copolymer thereof having a weight-average molecular weight of 10000 or less, polydimethylsilicone or polyalkylene oxide-modified polydimethylsilicone which is a liquid at normal temperature, polyethyleneimine or polyethylene oxide adduct (number-average addition molar number per N atom: 1 to 30) of polyethyleneimine which has a weight-average molecular weight of 10,000 or less, polyglycerin or polyalkylene oxide adduct of polyglycerin which is a liquid at normal temperature and polyalkylene oxide adduct of ethylenediamine which is a liquid at normal temperature.

Although a surfactant (hereinafter referred to as a component (e)) other than the component (a) may be used together with the intention of improving storage stability, considerable care must be taken in its use because if the component (e) is compounded excessively, it adheres to fiber products to give starchy feel so that the comfortable feel of these products is impaired. Examples of the surfactant, which may be used, may include anionic surfactants and nonionic surfactants other than the component (a) and amphoteric surfactants.

Examples of the anionic surfactant may include alkylbenzene sulfonates having 10 to 15 carbon atoms, alkyl sulfates having 10 to 16 carbon atoms, polyoxyethylene lauryl sulfates having an alkyl group having 10 to 16 carbon atoms and an oxyethylene group having a number-average addition mol number of 1 to 6, α-olefin sulfonates having 10 to 15 carbon atoms and α-sulfofatty acid methyl esters having 10 to 16 carbon atoms. Examples of the nonionic surfactant may include polyoxyethylene (and/or polyoxypropylene) alkyl ether type nonionic surfactants in which the number-average addition mol number of oxyalkylene groups is 4 to 30 and the alkyl group has 8 to 14 carbon atoms, alkyl polyglycosides in which the alkyl group has 8 to 16 carbon atoms and the degree of average condensation is 1 to 5 and fatty acid sorbitan esters with an alkyl group having 10 to 16 carbon atoms. Examples of the amphoteric surfactant may include alkyldimethylamine oxides with an alkyl group having 10 to 18 carbon atoms, alkanoylamidepropyldimethylamine oxides with an alkanoyl group having 10 to 18 carbon atoms, N-alkyl-N,N-dimethyl-N-(2-hydroxy-3-sulfopropyl)ammoniumbetaines and N-alkyl-N,N-dimethyl-N-carboxymethylammoniumbetaines with an alkyl group having 10 to 18 carbon atoms, and N-alkanoylaminopropyl-N,N-dimethyl-N-(2-hydroxy-3-sulfopropyl)ammoniumbetaines and N-alkanoylaminopropyl-N,N-dimethyl-N-carboxymethylammoniumbetaines with an alkanoyl group having 10 to 18 carbon atoms.

In the present invention, a surfactant selected from polyoxyethylene (and/or polyoxypropylene) alkyl ether type nonionic surfactants in which the number-average addition mol number of oxyalkylene groups is 4 to 20 and the alkyl group has 8 to 14 carbon atoms and alkyl polyglycosides in which the alkyl group has 8 to 16 carbon atoms and the average degree of condensation is 1 to 3.

The composition of the present invention preferably contains a water-soluble organic solvent (hereinafter referred to as a component (f)) from the view of obtaining a preferable appearance and improving storage stability. The content of the component (f) is preferably 0.5 to 40% by mass, more preferably 1 to 30% by mass, even more preferably 1.5 to 25% by mass, even more preferably 2 to 20% by mass. The component (f) is preferably a water-soluble organic solvent having an hydroxyl group and/or an ether group. Examples of the component (f) include the following compounds and it is preferable to use one or more of these compounds.

(i) alkanols such as ethanol, propanol, isopropanol and 1-butanol, (ii) polyhydric alcohols such as ethylene glycol, propylene glycol, butylene glycol, hexylene glycol and glycerin, (iii) polyglycols such as diethylene glycol, triethylene glycol, tetraethylene glycol, polyethylene glycol having an average molecular weight of about 200, polyethylene glycol having an average molecular weight of about 400, dipropylene glycol, tripropylene glycol and polypropylene glycol having an average molecular weight of about 1000, (iv) alkyl ethers such as diethylene glycol monomethyl ether, diethylene glycol dimethyl ether, triethylene glycol monomethyl ether, diethylene glycol monoethyl ether, diethylene glycol diethyl ether, dipropylene glycol monomethyl ether, dipropylene glycol monoethyl ether, tripropylene glycol monomethyl ether, 1-methoxy-2-propanol, 1-ethoxy-2-propanol, 1-methyl glyceryl ether, 2-methyl glyceryl ether, 1,3-dimethyl glyceryl ether, 1-ethyl glyceryl ether, 1,3-diethyl glyceryl ether, triethyl glyceryl ether, 1-pentyl glyceryl ether, 2-pentyl glyceryl ether, 1-octyl glyceryl ether, 2-ethylhexyl glyceryl ether and diethylene glycol monobutyl ether; (v) aromatic ethers such as 2-phenoxy ethanol, diethylene glycol monophenyl ether, triethylene glycol monophenyl ether, polyethylene glycol monophenyl ether having an average molecular weight of about 480, 2-benzyloxy ethanol and diethylene glycol monobenzyl ether and (vi) alkanolamines such as 2-amino ethanol, N-methylethanolamine, N,N-dimethylethanolamine, N,N-diethylethanolamine, diethanolamine, N-methyldiethanolamine, N-butyldiethanolamine, triethanolamine, triisopropanolamine and isopropanolamine mixtures (mixtures of mono, di and tri-amines).

The component (f) is preferably a combination of two or more compounds selected from the above (i) alkanols, (ii) polyhydric alcohols, (iv) alkyl ethers, (v) aromatic ethers and (vi) alkanolamines, more preferably a combination of two or more compounds selected from (i), (ii), (iv) and (v) and particularly preferably a combination of two or more compounds selected from (i), (ii) and (iv) to make it possible to improve the outward appearance and storage stability.

As the component (f), ethanol, propanol, isopropanol, ethylene glycol, propylene glycol, glycerin, 1-pentyl glyceryl ether, 2-pentyl glyceryl ether, 2-ethylhexyl glyceryl ether and diethylene glycol monobutyl ether are appropriate and particularly, ethanol, ethylene glycol, propylene glycol, 2-ethylhexyl glyceryl ether and diethylene glycol monobutyl ether are preferable.

The composition of the present invention preferably contains a water-soluble acid (hereinafter referred to as a component (g)) from the view of obtaining a desired outward appearance and improving storage stability. Examples of the water-soluble acid include hydrochloric acid, acetic acid, citric acid, succinic acid, fumaric acid, benzoic acid, lactic acid, butyric acid, phosphoric acid and sulfuric acid. These acids may be used either alone or in combinations of two or more. Among these acids, hydrochloric acid, acetic acid, citric acid and lactic acid are preferable and hydrochloric acid and citric acid are particularly preferable.

The fiber product treating agent composition of the present invention may take various forms according to treating methods. Specific examples of methods for obtaining these forms may include a method in which subject fiber products are directly immersed in the fiber product treating agent composition of the present invention (hereinafter referred to as a method 1), a method in which subject fiber products are immersed in a diluted solution obtained by diluting the fiber product treating agent composition of the present invention with water (hereinafter referred to as a method 2) and a method in which the fiber product treating agent composition is sprayed on subject clothes to allow the composition to adhere to these clothes (hereinafter referred to as a method 3). Here, the term "immerse" means the condition that the subject fibers are completely sunk in the composition of the present invention or an aqueous solution prepared by diluting the composition of the present invention.

The fiber product treating agent composition (hereinafter referred to as a composition (I) group) of the present invention to be subjected to the method 1 contains the component (a) in an amount of preferably 20 to 1000 ppm, more preferably 40 to 800 ppm and particularly preferably 60 to 600 ppm and the component (b) in an amount of 10 to 800 ppm, more preferably 20 to 600 ppm and particularly preferably 40 to 400 ppm, wherein the mass ratio of the component (a)/the component (b) is 4/1 to 1/4, preferably 3/1 to 1/2 and particularly preferably 2/1 to 1/1. Also, the composition (I) group may unnecessarily contain the components (c) and (d). However, when the component (c) is contained, the ratio ((a)/(c)) by mass of the component (a) to the component (c) is preferably 20/1 to 2/1, more preferably 15/1 to 3/1 and particularly preferably 10/1 to 4/1. Also, when the component (d) is contained, it is necessary to limit the content of especially the component (d1) to a lower level. Therefore, the ratio ([(a)+(b)]/(d1) (mass ratio) of "the total content of the components (a) and (b)" to the component (d1) in the composition (I) group of the present invention is preferably 100/0 to 80/20, more preferably 100/0 to 90/10 and particularly preferably 100/0 to 95/5. Also, with regard to the component (d2), it may be used in a small amount without any problem and the ratio ([(a)+(b)]/(d2)) (mass ratio) of "the total content of the components (a) and (b)" to the component (d2) in the composition (I) group of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) in the composition (I) group of the present invention is preferably 95/5 to 60/40, more preferably 95/5 to 70/30 and particularly preferably 95/5 to 80/20.

The total content of the component (c) and/or the component (d) in the composition (I) group is preferably 200 ppm or less, more preferably 150 ppm or less and particularly preferably 100 ppm or less. Also, the mass ratio of "the total content of the components (a) and (b)"/"the total content of the components (c) and (d)" in the composition (I) group is preferably 100/0 to 80/20, more preferably 95/5 to 80/20 and particularly preferably 95/5 to 85/15.

The components (e) and (f) in the composition (I) group may be contained as desired from the viewpoint of preparing a uniform solution of the components (a) and (b). In this case, the content of the component (e) is limited to preferably 200 ppm or less, more preferably 150 ppm or less and particularly preferably 100 ppm or less because excessive use of the component (e) adversely affects the feel of fiber products. The component (f) may be compounded in an arbitrary amount because this has no influence on the effect of the composition (I) group of the present invention. The component (f) gives rise to problems concerning flashing point and odor and therefore, the content of the component (f) is preferably 5 to 600 ppm, more preferably 10 to 400 ppm and particularly preferably 20 to 300 ppm.

The composition (I) group to be subjected to the method 1 has the form of an aqueous solution prepared by dissolving the above components in water and can be prepared by dissolving or dispersing each component in an arbitrary amount independently in water. The pH of the solution is preferably 2 to 9, more preferably 3 to 8 and particularly preferably 4 to 7 from the viewpoint of dissolution and dispersion stability. When the composition is adjusted to such a pH, a usual acid such as sulfuric acid, hydrochloric acid, phosphoric acid, acetic acid, citric acid, lactic acid and succinic acid and a usual alkali agent such as sodium hydroxide, potassium hydroxide, sodium carbonate and potassium carbonate may be used.

In the method 1, fiber products are immersed directly in the fiber product treating agent composition of the present invention. Specifically, the composition of the present invention is placed in a container such as a tub, a wash basin or a vat to carry out an operation of immersing the fiber products in the composition. As to the ratio of the fiber products to the composition of the present invention, the amount of the composition per 500 g of the fiber products is preferably 3 to 15 L, more preferably 4 to 13 L and particularly preferably 5 to 10 L. The temperature of the composition when the fiber products are immersed is preferably 5 to 40° C. and more preferably 10 to 30° C., and the immersing time is preferably 1 to 30 minutes, more preferably 3 to 20 minutes and particularly preferably 5 to 15 minutes. After immersed, the fiber products are dewatered and dried in the air or using a rotary type heating drier. The fiber products after dried are decreased in the formation of wrinkles to the extent that ironing is not required: however, the fiber products may be ironed with no problem when it is regarded as important to obtain better finish.

The fiber product treating agent composition (hereinafter referred to as a composition (II) group) of the present invention to be subjected to the method 2 contains the component (a) in an amount of preferably 1 to 60% by mass, more preferably 2 to 40% by mass and particularly preferably 5 to 30% by mass and the component (b) in an amount of 0.5 to 30% by mass, more preferably 1 to 20% by mass and particularly preferably 2 to 15% by mass, wherein the mass ratio of component (a)/component (b) is 4/1 to 1/4, preferably 3/1 to 1/2 and particularly preferably 2/1 to 1/1.

As to the method 2, in a typical method of using the composition (II) group of the present invention, the composition (II) group is added to rinsing water in a rinsing stage of a washing process. As compared with the method 1, the method 2 is more reduced in each concentration of the components (a) and (b) in the rinsing water. Therefore, in the composition (II) group, the component (c) is preferably compounded for the purpose of promoting the adsorption of the components (a) and (b) to fiber products. However, because when the component (c) is compounded excessively, this causes unacceptable feel. Therefore, when the component (c) is contained, the ratio ((a)/(c)) by mass of the component (a) to the component (c) in the component (II) group is preferably 20/1 to 1/1, more preferably 15/1 to 2/1 and particularly preferably 10/1 to 3/1. Also, the content of the component (c) in the composition (II) group is preferably 0.2% by mass or more and less than 5% by mass, more preferably 0.5% by mass or more and less than 3% by mass and particularly preferably 0.8% by mass or more and less than 2% by mass. Also, the ratio ([(a)+(b)]/(c) (mass ratio) of "the total content of the components (a) and (b)" to the component (c) in the composition (II) group of the present invention is preferably 40/1 to 2/1, more preferably 30/1 to 4/1 and particularly preferably 20/1 to 6/1 from the viewpoint of absorbing effective components efficiently fiber products and improving the effect of the present invention. Also, when the component (d) is contained, it is necessary to limit the content of especially the component (d1) to a lower level. Therefore, the content of the component (d1) in the composition (II) group in the present invention is preferably 2% by mass or less, more preferably 1% by mass or less and particularly preferably 0.5% by mass or less. The ratio ([(a)+(b)]/(d1) (mass ratio) of "the total content of the components (a) and (b)" to the component (d1) in the composition (II) group of the present invention is preferably 100/0 to 80/20, more preferably 100/0 to 90/10 and particularly preferably 100/0 to 95/5. Also, with regard to the component (d2), it may be used in a small amount and the ratio ([(a)+(b)]/(d2)) (mass ratio) of "the total content of the components (a) and (b)" to the component (d2) in the composition (II) group of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) is preferably 95/5 to 60/40, more preferably 95/5 to 70/30 and particularly preferably 95/5 to 80/20.

The mass ratio of "the total content of the components (a) and (b)"/"the total content of the components (c) and (d)" in the composition (II) group is preferably 98/2 to 80/20, more preferably 95/5 to 80/20 and particularly preferably 90/10 to 80/20.

The components (e) and (f) in the composition (II) group may be contained properly from the viewpoint of making the composition of the present invention superior in appearance and improving the storage stability of the composition. In this case, the content of the component (e) is limited to preferably 20% by mass or less, more preferably 15% by mass or less and particularly preferably 10% by mass or less because excessive use of the component (e) adversely affects the feel of fiber products. The component (f) may be compounded in an arbitrary amount because this has no influence on the effect of the composition (II) group of the present invention. The component (f) gives rise to problems concerning flashing point and odor and therefore, the content of the component (f) is preferably 0.5 to 40% by mass, more preferably 1 to 30% by mass and particularly preferably 2 to 20% by mass.

The composition (II) group to be subjected to the method 2 has the form of an aqueous solution prepared by dissolving the above components in water. The content of water is preferably 20 to 90% by mass, more preferably 30 to 80% by mass, even more preferably 40 to 70% by mass. Also, the pH of the composition and the pH adjusting method are the same as those in the case of the composition (I) provided for the method 1.

As to the method 2, a method of adding the composition (II) group of the present invention to rinsing water in a rinsing stage of a washing process is preferable. The amount of the composition of the present invention to be added is preferably 7 to 40 ml per 1 kg of clothes, more preferably 10 to 30 ml, even more preferably 15 to 25 ml from the view of producing the effect of the present invention. The temperature of the rinsing water is preferably 5 to 40° C. and more preferably 10 to 30° C. The treating time is preferably 1 to 30 minutes, more preferably 3 to 20 minutes and particularly preferably 5 to 15 minutes. After immersed, the fiber products are dewatered and dried in the air or using a rotary type heating drier. The fiber products after dried are decreased in the formation of wrinkles to the extent that ironing is not required: however, the fiber products may be ironed with no problem when it is regarded as important to obtain better finish.

The method 3 is a method in which the composition of the present invention is filled in a container equipped with a sprayer to spray the composition on subject fiber products. The concentration of each component in the fiber product treating agent composition (hereinafter referred to as a composition (III) group) of the present invention in the method 3 must be lower than that in the method 2 because of a problem as to clogging of the sprayer. Specifically, the composition contains the component (a) in an amount of 0.05 to 3% by mass, more preferably 0.1 to 2.5% by mass and particularly preferably 0.2 to 2% by mass and the component (b) in an amount of 0.05 to 3% by mass, more preferably 0.1 to 2.5% by mass and particularly preferably 0.2 to 2% by mass, wherein the mass ratio of the component (a)/the component (b) is 4/1 to 1/4, preferably 3/1 to 1/3 and particularly preferably 2/1 to 1/2.

Unlike the method 2, the method is free from the problem concerning a lack of efficiency of adsorption to fiber products which are the subject of the components (a) and (b), because the composition of the present invention adsorbs directly to clothes in the method 3. The composition (III) group unnecessarily contains the component (c) and the compound (c) is allowed to be compounded to the extent that the feel of fiber products to be expected by treatment using the composition of the present invention is not impaired. For this reason, the content of the component (c) is preferably less than 2% by mass and more preferably less than 1% by mass. Also, it is necessary to limit the content of especially the component (d1) among the component (d) to a lower level. Therefore, the ratio ([(a)+(b)]/(d1) (mass ratio) of "the total content of the components (a) and (b)" to the component (d1) in the composition (III) group of the present invention is preferably 100/0 to 80/20, more preferably 100/0 to 90/10 and particularly preferably 100/0 to 95/5. Also, with regard to the component (d2), it may be used in a small amount and the ratio ([(a)+(b)]/(d2)) (mass ratio) of "the total content of the components (a) and (b)" to the component (d2) in the composition (III) group of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) is preferably 95/5 to 60/40, more preferably 95/5 to 70/30 and particularly preferably 95/5 to 80/20.

The total content of the components (c) and/or (d) in the composition (III) group is preferably 5% by mass or less, more preferably 3% by mass or less and particularly preferably 1% by mass or less. The mass ratio of "the total content of the components (a) and (b)"/"the total content of the components (c) and (d)" in the composition (III) group is preferably 100/0 to 80/20, more preferably 95/5 to 80/20 and particularly preferably 95/5 to 85/15.

The components (e) and (f) in the composition (III) group may be contained as desired from the viewpoint of making the composition of the present invention superior in appearance, improving the storage stability of the composition and suppressing clogging of nozzles of the sprayer. In this case, the content of the component (e) is limited to preferably 10% by mass or less, more preferably 5% by mass or less and particularly preferably 3% by mass or less because excessive use of the component (e) adversely affects the feel of fiber products. The component (f) may be compounded in an arbitrary amount because this has no influence on the effect of the composition (III) group of the present invention. The component (f) gives rise to problems concerning flashing point and odor and therefore, the content of the component (f) is preferably 0.5 to 20% by mass, more preferably 1 to 15% by mass and particularly preferably 2 to 10% by mass.

The composition (III) group to be subjected to the method 3 has the form of an aqueous solution prepared by dissolving the above components in water. The content of water is preferably 40 to 99% by mass, more preferably 60 to 98% by mass and particularly preferably 80 to 95% by mass. Also, the pH of the composition and the pH adjusting method are the same as those in the case of the composition (I) provided for the method 1.

The spray container used in the method 3 is preferably a trigger type spray container and it is particularly desirable to use an accumulator type trigger superior in prevention of liquid oozing and in uniform spraying as shown in, particularly, FIG. 1 of JP-A (U) 4-37554.

A trigger type spray container used in the present invention is preferably a type which jets liquid droplets in an amount of 0.2 g to 2.0 g, preferably 0.25 to 1.5 g and particularly preferably 0.3 to 1.0 g per stroke and particularly preferably a container so designed that the area exposed to the liquid sprayed from a place 15 cm apart therefrom in a horizontal direction parallel to a subject surface (plane) disposed vertically to the ground is 100 to 800 $cm^2$ and preferably 150 to 600 $cm^2$. Also, the composition of the present invention is preferably sprayed uniformly on fiber products such that the total amount of the components (a) and (b) is preferably 0.01 to 4 g, more preferably 0.05 to 3 g and particularly preferably 0.1 to 2 g in each 100 $cm^2$ of fiber products.

There are various choices on the timing of spray treatment for fiber products in the method 3 and the following methods may be adopted: a method in which wet fiber products after dewatered in the washing process are hung with a hanger or the like and the composition (III) group of the present invention is uniformly sprayed on the wet fiber products, followed by air-drying, a method in which the composition (III) group of the present invention is sprayed uniformly on fiber products that have been dried in the air or by a rotary type heating drier after washed and then the fiber products are dried again and a method in which after fiber products are place in a rotary heating drier, the composition is sprayed on these fiber products and these fiber products were dried under heating. The dried fiber product after the treatment is decreased in the formation of wrinkles to the extent that ironing is not required. The fiber product, however, may be ironed with no problem when it is regarded as important to obtain better finish.

The composition to be subjected to the methods 1 to 3 of the present invention may contain components that are to be added in general liquid compositions: specifically, it may contain, for example, an antiseptic, perfumes, pigments, dyes, hydrotropic agent, thickener, gelling preventive and antioxidant.

The present invention is a fiber product treating agent composition containing (a), (b) and (m). The details of (a) and (b) are as mentioned above. The composition may contain the above (c).

The component (m) used in the present invention is a silicone compound having a polyoxyalkylene chain. As the polyoxyalkylene chain, those in which the alkylene group has 2 to 4 and particularly 2 to 3 carbon atoms and the ratio of the average addition mol number of oxyalkylene groups to the average mol number of silicon atoms to be contained in one molecule of the silicone compound is preferably 5 to 50%, more preferably 5 to 40% and particularly preferably 10 to 30%. The addition of the oxyalkylene group to the silicone chain may be any of a pendant type, block type and the like. Also, the mass ratio of oxyethylene groups in the oxyalkylene group is preferably 50% or more.

The component (m) is particularly preferably a compound represented by the formula (6).

(6)

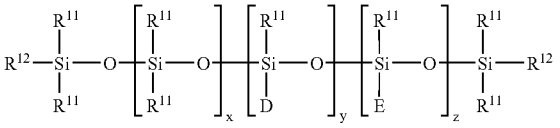

in the formula, x denotes a number from 100 to 600 and is given by the following equations in relation to y and z, which are respectively a number given by the following equations: x:y=100:1 to 10:1 and y:z=1:10 to 10:1. Plural $R^{11}$s, which may be the same or different, respectively represents an alkyl group having 1 to 4 carbon atoms. Two $R^{12}$s, which may be the same or different, respectively represent an alkyl group having 1 to 4 carbon atoms, a hydroxyalkyl group or an alkoxy group. D is a group represented by the following formula (i) or a mixture of a group represented by the formula (i) and a group represented by the formula (ii), wherein in the latter case, the proportion of the group represented by the formula (ii) in D is 50 mol % or less.

(i)

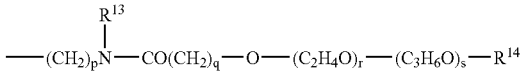

(ii)

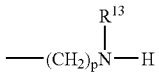

In the formula, p denotes a number from 2 to 6, $R^{13}$ represents a hydrogen atom or an alkyl group having 1 to 4 carbon atoms, q denotes a number from 1 to 6, r denotes a number from 1 to 20, s denotes a number from 0 to 20, $R^{14}$ represents an alkyl group having 1 to 18 carbon atoms, where the oxyethylene group and the oxypropylene group may be bonded by either random addition or block addition.

E represents a group represented by the formula (iii) or an alkyl group having 1 to 4 carbon atoms.

$$—(CH_2)_t—O—(C_2H_4O)_u—(C_3H_6O)_v—R^{15} \quad \text{(iii)}$$

In the formula, $R^{15}$ represents an alkyl group having 1 to 20 carbon atoms, t denotes a number from 2 to 6, u denotes a number from 1 to 20 and v denotes a number from 0 to 20, where the oxyethylene group and the oxypropylene group may be bonded by either random addition or block addition.

The composition of the present invention can impart moderate water absorbing property to fiber products when it contains the above components (b) and (m) in a mass ratio of 1/2 to 10/1.

In the composition containing the components (a), (b) and (m), a high-molecular compound (hereinafter referred to as a component (d1)) superior in film forming ability when dried at normal temperature (25° C.) among high-molecular compounds (hereinafter referred to as a component (d)) which do not correspond to the components (a), (b) and (m) may be used in a small amount for the purpose of improving storage stability and for rheology control. However, it is necessary to limit the content of the component (d1) to a lower level. Therefore, the ratio ([(a)+(b)+(m)]/(d1) (mass ratio) of "the total content of the components (a), (b) and (m)" to the component (d1) in the composition of the present invention is preferably 100/0 to 80/20, more preferably 100/0 to 90/10 and particularly preferably 100/0 to 95/5. On the other hand, a high-molecular compound (hereinafter referred to as a component (d2)) which forms little film when dried at normal temperature (25° C.) among the component (d) may be used in a small amount with no problem and may be used to the extent that the effect of the present invention is not adversely affected. However, it is preferable to decrease the content of the component (d2) than that of the component (a). Therefore, the ratio ([(a)+(b)+(m)]/(d2) (mass ratio) of "the total content of the components (a), (b) and (m)" to the component (d2) in the composition of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) is preferably 95/5 to 60/40, more preferably 95/5 to 70/30 and particularly preferably 95/5 to 80/20.

In the composition containing the components (a), (b) and (m), the fiber product treating agent composition (hereinafter referred to as a composition (I') group) of the present invention to be subjected to the method 1 contains the component (a) in an amount of preferably 20 to 1000 ppm, more preferably 40 to 800 ppm and particularly preferably 60 to 600 ppm, the component (b) in an amount of 10 to 800 ppm, more preferably 20 to 600 ppm and particularly preferably 40 to 400 ppm and the component (m) in an amount of preferably 1 to 400 ppm, more preferably 2 to 200 ppm and particularly preferably 4 to 100 ppm, wherein the mass ratio of component (a)/component (b) is 4/1 to 1/4, preferably 3/1 to 1/2 and particularly preferably 2/1 to 1/1, the mass ratio of component (b)/component (m) is 1/2 to 10/1, preferably 1/1 to 10/1 and particularly preferably 2/1 to 8/1. Also, the composition (I') group may not contain the components (c) and (d). However, when the component (c) is contained, the ratio ((a)/(c)) by mass of the component (a) to the component (c) is preferably 20/1 to 2/1, more preferably 15/1 to 3/1 and even more preferably 10/1 to 4/1. Also, when the component (d) is contained, it is necessary to limit the content of especially the component (d1) to a lower level. Therefore, the ratio ([(a)+(b)+(m)]/(d1) (mass ratio) of "the total content of the components (a), (b) and (m)" to the component (d1) in the composition (I') group of the present invention is preferably 100/0 to 80/20, more preferably 100/0 to 90/10 and particularly preferably 100/0 to 95/5. Also, with regard to the component (d2), it may be formulated in a small amount and the ratio ([(a)+(b)+(m)]/(d2)) (mass ratio) of "the total content of the components (a), (b) and (m)" to the component (d2) in the composition (I') group of the present invention is preferably 100/0 to 80/20, more preferably 95/5 to 80/20 and particularly preferably 95/5 to 85/15. Also, the ratio ((a)/(e2)) (mass ratio) of the component (a) to the component (d2) is preferably 95/5 to 60/40, more preferably 95/5 to 70/30 and particularly preferably 95/5 to 80/20.

The total content of the component (c) and/or the component (d) in the composition (I') group is preferably 200 ppm or less, more preferably 150 ppm or less and particularly preferably 100 ppm or less. Also, the mass ratio of "the total content of the components (a), (b) and (m) "/" the total content of the components (m) and (c)" in the composition (I') group is preferably 100/0 to 80/20, more preferably 95/5 to 80/20 and particularly preferably 95/5 to 85/15.

The components (e) and (f) in the composition (I') group may be contained as desired from the viewpoint of preparing a uniform solution of the components (a), (b) and (m) in the same manner as in the case of (I). The composition (I') group may be prepared and applied to fiber products in the same manner as in the case of (I).

The fiber product treating agent composition (hereinafter referred to as a composition (II') group) of the present invention to be subjected to the method 2 contains the component (a) in an amount of preferably 1 to 60% by mass, more preferably 2 to 40% by mass and particularly preferably 5 to 30% by mass, the component (b) in an amount of preferably 0.5 to 30% by mass, more preferably 1 to 20% by mass and particularly preferably 2 to 15% by mass and the component (m) in an amount of 0.1 to 30% by mass, more preferably 0.5 to 20% by mass and particularly preferably 1 to 15% by mass, wherein the mass ratio of the component (a)/the component (b) is 4/1 to 1/4, preferably 3/1 to 1/2 and particularly preferably 2/1 to 1/1 and the mass ratio of component (b)/component (m) is 1/2 to 10/1, preferably 1/1 to 10/1 and particularly preferably 2/1 to 8/1.

As to the method 2, in a typical method of using the composition (II') group of the present invention, the composition (II') group is added to rinsing water in a rinsing stage of a washing process. As compared with the method 1, the method 2 is more reduced in each concentration of the components (a), (b) and (m) in the rinsing water. Therefore, in the composition (II') group, the component (c) is preferably compounded for the purpose of promoting the adsorption of the components (a), (b) and (m) to fiber products. However, because when the component (c) is compounded excessively, this causes unacceptable feel. Therefore, when the component (c) is contained, the ratio ((a)/(c)) by mass of the component (a) to the component (c) is preferably 20/1 to 1/1, more preferably 15/1 to 2/1 and particularly preferably 10/1 to 3/1. Also, the content of the component (c) in the composition (II') group is preferably 0.2% by mass or more and less than 5% by mass, more preferably 0.5% by mass or more and less than 3% by mass and particularly preferably 0.8% by mass or more and less than 2% by mass. Also, the ratio ([(a)+(b)+(m)]/(c) (mass ratio) of "the total content of the components (a), (b) and (m)" to the component (c) in the composition (II') group of the present invention is preferably 40/1 to 2/1, more preferably 30/1 to 4/1 and particularly preferably 20/1 to 6/1 from the viewpoint of absorbing effective components efficiently fiber products and improving the effect of the present invention. Also, when the component (d) is contained, it is necessary to limit the content of especially the component (d1) to a lower level. Therefore, the content of the component (d1) in the composition (II') group in the present invention is preferably 2% by mass or less, more preferably 1% by mass or less and particularly preferably 0.5% by mass or less. The ratio ([(a)+(b)+(m)]/(d1) (mass ratio) of "the total content of the components (a), (b) and (m)" to the component (d1) in the composition (II') group of the present invention is preferably 100/0 to 80/20, more preferably 100/0 to 90/10 and particularly preferably 100/0 to 95/5. Also, with regard to the component (d2), it may be used in a small amount with no problem and the ratio ([(a)+(b)+(m)]/(d2)) (mass ratio) of "the total content of the components (a), (b) and (m)" to the component (d2) in the composition (II') group of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) is preferably 95/5 to 60/40, more preferably 95/5 to 70/30 and particularly preferably 95/5 to 80/20.

The mass ratio of "the total content of the components (a), (b) and (m)"/"the total content of the components (c) and (d)" in the composition (II') group is preferably 98/2 to 80/20, more preferably 95/5 to 80/20 and particularly preferably 90/10 to 80/20.

The components (e) and (f) may also be contained in the composition (II') group similarly to the case of (II).

The method 3 is a method in which the composition of the present invention is filled in a container equipped with a sprayer to spray the composition on subject fiber products. The concentration of each component in the fiber product treating agent composition (hereinafter referred to as a composition (III') group) of the present invention in the method 3 must be lower as compared with that in the method 2 because of a problem as to clogging of the sprayer. Specifically, the composition contains the component (a) in an amount of 0.05 to 3% by mass, more preferably 0.1 to 2.5% by mass and particularly preferably 0.2 to 2% by mass, the component (b) in an amount of 0.05 to 3% by mass, more preferably 0.1 to 2.5% by mass and particularly preferably 0.2 to 2% by mass and the component (m) in an amount of preferably 0.01 to 3% by mass, more preferably 0.02 to 2.5% by mass and particularly preferably 0.04 to 2% by mass, wherein the mass ratio of the component (a)/the component (b) is 4/1 to 1/4, preferably 3/1 to 1/3 and particularly preferably 2/1 to 1/2 and the mass ratio of the component (b)/the component (m) is 1/2 to 10/1, preferably 1/1 to 10/1 and particularly preferably 2/1 to 8/1.

Unlike the method 2, the method 3 is free from the problem concerning a lack of efficiency of adsorption to fiber products which are the subject of the components (a) (b) and (m), because the composition of the present invention adsorbs directly to clothes in the method 3. The composition (III') group may not necessarily contain the component (c) and the compound (c) is allowed to be compounded to the extent that the feel of fiber products to be expected by treatment using the composition of the present invention is not impaired. For this, the content of the component (c) is preferably less than 2% by mass and more preferably less than 1% by mass. Also, it is necessary to limit the content of especially the component (d1) among the component (d) to a lower level. Therefore, the ratio ([(a)+(b)+(m)]/(d1) (mass ratio) of "the total content of the components (a), (b) and (m)" to the component (d1) in the composition (III') group of the present invention is preferably 100/0 to 80/20, more preferably 100/0 to 90/10 and particularly preferably 100/0 to 95/5. Also, with regard to the component (d2), the ratio ([(a)+(b)+(m)]/(d2)) (mass ratio) of "the total content of the components (a), (b) and (m)" to the component (e2) in the composition (III') group of the present invention is preferably 100/0 to 80/20, more preferably 95/5 to 80/20 and particularly preferably 95/5 to 85/15. Also, the ratio ((a)/(d2)) (mass ratio) of the component (a) to the component (d2) is preferably 95/5 to 60/40, more preferably 95/5 to 70/30 and particularly preferably 95/5 to 80/20.

The total content of the components (c) and/or (d) in the composition (III') group is preferably 5% by mass or less, more preferably 3% by mass or less and particularly preferably 1% by mass or less. The mass ratio of "the total content of the components (a), (b) and (m)"/"the total content of the components (c) and (d)" in the composition (III') group is preferably 100/0 to 80/20, more preferably 95/5 to 80/20 and particularly preferably 95/5 to 85/15.

The components (e) and (f) in the composition (III') group may be contained as desired from the viewpoint of preparing a uniform solution of the components (a), (b) and (m) in the same manner as in the case of (III). The composition (III') group may be prepared and applied to fiber products in the same manner as in the case of (III).

EXAMPLES

Examples 1 to 4 and 11 to 15 are described below. The following examples are examples of the present invention and are not intended to be limiting of the present invention.

The ingredients used in the examples and comparative examples shown in Tables 1 to 3 are listed below.

Component (a)

(a)-1: Nonionic surfactant (HLB: 19.2, melting point: 60.9° C.) prepared by adding ethylene oxide to stearyl alcohol in an amount of an average of 140 mol per 1 mol of the alcohol.

(a)-2: Nonionic surfactant (HLB: 18.7, melting point: 60.3° C.) prepared by adding ethylene oxide to Kalcol 8688 (manufactured by Kao Corporation, straight-chain primary alcohol in which the content of an alcohol having 18 carbon atoms is 87% by mass, the content of an alcohol having 16 carbon atoms is 13% by mass and the content of an alcohol having 14 carbon atoms is less than 0.1% by mass) in an amount of an average of 90 mol per 1 mol of the alcohol (a)-3: Nonionic surfactant (HLB: 19.1, melting point: 61.2° C.) prepared by adding ethylene oxide to Kalcol 8688 in an amount of an average of 130 mol per 1 mol of the alcohol.

(a)-4: Nonionic surfactant (HLB: 19.4, melting point: 61.5° C.) prepared by adding ethylene oxide to Kalcol 6870 (manufactured by Kao Corporation, straight-chain primary alcohol in which the content of an alcohol having 16 carbon atoms is 71% by mass, the content of an alcohol having 18 carbon atoms is 21% by mass, the content of an alcohol having 14 carbon atoms is 6% by mass and the content of an alcohol having 12 carbon atoms is 2% by mass) in an amount of an average of 180 mol per 1 mol of the alcohol.

Component (b)

(b)-1: SF8457C (amino-modified silicone, manufactured by Dow Corning Toray Silicone Co., Ltd., viscosity: 1200 $mm^2/s$, amino equivalent: 1800).

(b)-2: TSF4707 (amino-modified silicone, manufactured by GE Toshiba Silicones, viscosity: 10000 $mm^2/s$, amino equivalent: 7000).

(b)-3: SM8704C (aqueous emulsion of amino-modified silicone, manufactured by Dow Corning Toray Silicone Co., Ltd., base oil content: 40%).

Component (c)

(c)-1: Quartamin D86P (manufactured by Kao Corporation, distearyldimethylammonium chloride)

(c)-2: Quartamin 86W (manufactured by Kao Corporation, stearyltrimethylammonium chloride)

Component (d1)

(d1)-1: Poise C-60H (manufactured by Kao Corporation, cationic cellulose, molecular weight: about 600000).

(d1)-2: PVA-217 (manufactured by Kuraray Co., Ltd., partially saponified polyvinyl alcohol).

Component (d2)

(d2)-1: PEG6000 (polyethylene glycol, average molecular weight: 6000)

Component (e)

(e)-1: Nonionic surfactant (HLB: 15.1) prepared by adding ethylene oxide to myristyl alcohol in an amount of an average of 15 mol per 1 mol of the alcohol.

(e)-2: Nonionic surfactant prepared by adding ethylene oxide to Kalcol 40 (manufactured by Kao Corporation) in an amount of an average of 20 mol per 1 mol of the alcohol.

(e)-3: Nonionic surfactant prepared by adding an average of 5 mol of ethylene oxide, an average of 2 mol of propylene oxide and an average of 3 mol of ethylene oxide in this order to a straight-chain primary alcohol having 12 to 14 carbon atoms.

(e)-4: Softanol 70 (manufactured by Nippon Shokubai Co., Ltd.).

Component (f)

(f)-1: Diethylene glycol monobutyl ether.

(f)-2: Ethanol.

(f)-3: Propylene glycol.

Component (g)

(g)-1: Citric acid.

(g)-2: Lactic acid.

(g-3): Hydrochloric acid (effective component of HCl: 35%).

Other Components

Antibacterial agent: Proxel IB (manufactured by Avecia kk, aqueous 20% solution)

Dye: Violet 201

Example 1

0.8 g of a nonionic surfactant ((a)-1) prepared by adding ethylene oxide to stearyl alcohol in an amount of an average of 140 mol, 0.5 g of a nonionic surfactant ((e)-1) prepared by adding ethylene oxide to myristyl alcohol in an amount of an average of 15 mol, 1 g of amino-modified silicone ((b)-1) and 1 g of citric acid ((g)-1) were dissolved in 5 L of tap water to obtain a fiber product treating agent composition.

One shirt (BLUE RIVER, white, cotton: 100%, manufactured by Flex Japan Co., Ltd., shape stability processed shirt (SSP)), which had been pretreated in the following method) was immersed in the obtained composition (20° C. solution). The immersing time was 10 minutes. Thereafter, this shirt was dewatered for 3 minutes in a dewatering process of a washing machine (NAF 80 SP1, manufactured by National) and then hung out on a hunger out of the sun for 12 hours to dry. The dried shirt was evaluated as to the condition of feel and wrinkles. The results are shown in Table 1.

Method of Pretreating Fiber Products for Evaluation

A shirt (BLUE RIVER, white, cotton: 100%, manufactured by Flex Japan Co., Ltd., shape stability processed shirt (SSP)) was washed repeatedly 10 times using a commercially available weak-alkaline detergent (Attack, manufactured by Kao Corporation) in a twin-tub type washing machine (Toshiba Ginga VH-360S1) (detergent concentration: 0.0667% by mass, using 40 L (20° C.) of tap water, washing (10 minutes)-dewatering (3 minutes)-rinsing (8 minutes) (rinsing in water stream, amount of water: 15 L/min.)). After the final rinsing process was finished, the shirt was dewatered for 5 minutes and was subjected to natural lay drying in a 25° C.-65 RH thermohygrostat to make a fiber product for evaluation.

Method of Evaluation of Feel to the Touch

A fiber product that was humidity-conditioned for 24 hours in a 25° C.-65 RH thermohygrostat after it was treated by each treating agent composition and hung for 12 hours to dry was evaluated as to softness, tenseness, starchiness, and smoothness by five panelists who kept a record of points based on the following standard to calculate an average of the points of the panelists. In this case, a fiber product which was treated only by tap water without using any treating agent and was likewise humidity-conditioned in a 25° C.-65 RH thermohygrostat after it was pretreated was used as a control. Each sample was judged based on the following standard: ⊙: the average exceeds 1.0 and is 2.0 or less, ○: the average exceeds 0 and is 1.0 or less, Δ: the average is 0, x: the average is −1.0 or more and less than 0 and xx: the average is −2.0 or more and less than −1.0.

Softness

The control is softer: +2 point

The control is slightly softer: +1 point

The same as the control: 0 point

Slightly softer than the control: −1 point

Softer than the control: −2 point

Tenseness

Tenser than the control: +2 point

Slightly tenser than the control: +1 point

The same as the control: 0 point

The control is slightly tenser: −1 point

The control is tenser: −2 point

Starchiness

The control is more starchy: +2 point

The control is slightly more starchy: +1 point

The same as the control: 0 point

Slightly more starchy than the control: −1 point

More starchy than the control: −2 point

Smoothness

Smoother than the control: +2 point

Slightly smoother than the control: +1 point

The same as the control: 0 point

The control is slightly smoother: −1 point

The control is smoother: −2 point

Method of Evaluation of Wrinkles

A fiber product that was treated by each treating agent composition and hung for 12 hours to dry was evaluated by five panelists who kept a record of points based on the following standard to calculate an average of the points of the panelists. In this case, a fiber product which was treated only by tap water without using any treating agent and was likewise dried after it was pretreated was used as a control. Each sample was judged based on the following standard: ⊙: the average exceeds 1.0 and 2.0 or less, ○: the average exceeds 0 and 1.0 or less, Δ: the average is 0, x: the average is −1.0 or more and less than 0 and xx: the average is −2.0 or more and less than −1.0.

Wrinkles

More reduced in wrinkles than the control: +2 point

A slightly reduced in wrinkles than the control: +1 point

The same as the control: 0 point

The control is slightly reduced in wrinkles: −1 point

The control is more reduced in wrinkles: −2 point

Comparative Example 1

A composition prepared by adding distearyldimethylammonium chloride ((c)-1) (1 g of distearyldimethylammonium chloride based on effective component was dissolved in 200 g of warm water, which was temperature-controlled to 20° C., and then added to the composition) in place of the component (a) in Example 1 was used to evaluate in the same manner as in Example 1. The results are shown in Table 1.

Comparative Example 2

A composition prepared by adding 1 g of Poise C-60H ((d1)-1) (1 g of Poise C-60H based on effective component was dissolved in 200 g of warm water, which was temperature-controlled to 20° C., and then added to the composition) in place of the component (a) in Example 1 was used to evaluate in the same manner as in Example 1. The results are shown in Table 1.

TABLE 1

| | | | Example 1 | Comparative example 1 | Comparative example 2 |
|---|---|---|---|---|---|
| Treating agent composition (wt %) | | (a)-1 | 0.016 | | |
| | | (b)-1 | 0.02 | 0.02 | 0.02 |
| | | (c)-1 | | 0.02 | |
| | | (d1)-1 | | | 0.02 |
| | | (e)-1 | 0.01 | 0.01 | 0.01 |
| | | (g)-1 | 0.02 | 0.02 | 0.02 |
| | | Water | Balance | Balance | Balance |
| | | Total | 100 | 100 | 100 |
| (a)/(b) (mass ratio) | | | 0.8 | — | — |
| Result of evaluation | Feel | Softness | Δ | X X | ○ |
| | | Tenseness | ○ | X X | ◎ |
| | | Starchiness | ◎ | ◎ | X X |
| | | Smoothness | ◎ | ○ | X |
| | | Wrinkles | ◎ | ◎ | X |

As is clear from the results shown in Table 1, the shirt treated with the treating agent composition of Example 1 was not softer than the control (the same as the control) but was not starchy and was smooth and slightly tensile. Also, the shirt after dried in a hanging condition was more reduced in wrinkles than the control and was on the level allowing satisfactory wear without ironing. On the other hand, the shirt treated with the treating agent composition of Comparative Example 1 had softer feel and less starchy feel as compared with the control so that it had the feel specific in the case of using a softener. However, the shirt treated with the treating agent composition of Comparative Example 1 did not exhibit tenseness which was the object of the present invention at all and therefore had no effect of the present invention. The shirt after dried in a hanging condition was decreased in wrinkles, was more reduced in wrinkles than the control and was on the level allowing satisfactory wear without ironing. Although the shirt treated with the treating agent composition of Comparative Example 2 exhibited higher tenseness than the control, it exhibited starchy feel specific in the case of using a sizing agent, had neither smoothness nor softness and had no favorable feel unlike the present invention. Also, the shirt after dried in a hanging condition had wrinkles, had more wrinkles than the control and was not on the level allowing wear without ironing.

Example 2

Using each component shown in Table 2, each fiber product treating agent composition shown in Table 2 was prepared in an amount of 150 g. At this time, a polypropylene plastic cup (volume: 200 mL) was used as a mixing container and a magnetic stirrer was used in the mixing method. First, the components (e) and (f) were weighed and mixed with each other in the container and then, the component (a) heated to a temperature above the melting point was added to the mixture, which was then mixed further. Water was added to the resulting mixture in an amount corresponding to 10% by mass of all the composition, followed by further mixing. Next, the component (b) was poured into the mixture at a rate of 2 g/min. in a predetermined amount with mixing and the resulting mixture was further mixed for about 30 minutes after the addition of the component (b) was finished. To the resulting mixture was added the remainder of the water to be compounded followed by mixing and the component (c) was added to the mixture. The component (d) was added with continuing mixing and other components were added, followed by adjusting the resulting mixture to a predetermined pH by using the component (g) to obtain each composition. The performances of the resulting compositions were evaluated in the following methods. The results of evaluation are shown in Table 2.

Method of Evaluation

As clothes for evaluation, one new cut-sew (manufactured by (k.k.) Chikuma, 9 to 5, beige, cotton/polyester=50/50%) and one new shirt (BLUE RIVER, white, cotton: 100%, manufactured by Flex Japan Co., Ltd., shape stability processed shirt (SSP)) were prepared and 0.9 kg of an undershirt (cotton: 100%) and 0.6 kg of a shirt (white, cotton/polyester=60/40) were added as weight adjusting clothes to these clothes. A total amount of 1.8 kg of these clothes was washed repeatedly 10 times using a commercially available weak-alkaline detergent (Attack, manufactured by Kao Corporation) in a twin-tub type washing machine (Toshiba Ginga VH-360S1) (detergent concentration: 0.0667% by mass, using 36 L (20° C.) of tap water, washing (10 minutes)-dewatering (3 minutes)-rinsing (8 minutes) (rinsing in water stream, amount of water: 15 L/min.)). The flow of water was stopped 5 minutes after the final rinsing process (10th time) was started, the washed water was drained off and then the shirt was dewatered for 3 minutes. Then, 36 L of tap water (20° C.) was poured into the washing machine and 23.33 g of each treating agent composition of Table 2 was poured, followed by stirring treatment carried out for 3 minutes. After the stirring was stopped, these clothes were dewatered for 3 minutes and the cut-sew and the shape stability processed shirt were taken out as clothes for evaluation. The clothes for evaluation were hung on a hunger out of the sun to dry these clothes in a hanging condition for 12 hours. The dried clothes were evaluated as to feel to the touch and wrinkles in the same manner as in Example 1. The cut-sew and the shape stability processed shirt were both evaluated in contrast with the control and the both had the same tendencies. The results of the shape stability processed shirt are shown in Table 2. Also, each treating agent composition was evaluated as to a charge port of the washing machine.

Method of evaluation as to a charge port of a washing machine

Using a automatic washing machine (National Three-stage washing Method NAF80SP1) provided with a tray style softener charge port, the condition of the inside of the charge port in cumulative use (general course, 20° C. tap water, the amount of water passing through the charge port: about 1 L, each treating agent: 40 g/time, accumulation of five times (once daily)) was observed and evaluated according to the following standard.

No adsorbed substance is observed both on the inside wall of the charge port and at the liquid discharge port: ○

Adsorbed substances are observed on the inside wall of the charge port or at the liquid discharge port: Δ

Adsorbed substance are observed both on the inside wall of the charge port and at the liquid discharge port: x

TABLE 2

| | | | Product of the invention | | | | | | | Comparative Product | |
|---|---|---|---|---|---|---|---|---|---|---|---|
| | | | 1 | 2 | 3 | 4 | 5 | 6 | 7 | 1 | 2 |
| Treating agent composition (wt %) | (a) | (a)-2 | 8 | | | 4 | 8 | | 6 | | |
| | | (a)-3 | | 8 | | | | 8 | 2 | | |
| | | (a)-4 | | | 8 | 4 | | | | | |
| | (b) | (b)-2 | 6 | | | 8 | 6 | 8 | 6 | | 6 |
| | | (b)-3 | | 8 | 16 | | | | | 8 | |
| | (c) | (c)-1 | | | 1 | 1 | 3 | | 2 | | |
| | | (c)-2 | 1 | 0.5 | 1 | | | | | 0.5 | |
| | (d) | (d1)-1 | 0.05 | | | | | | | | 4 |
| | | (d1)-2 | | 0.5 | | | 0.5 | | | 0.5 | 0.5 |
| | | (d2)-1 | | | 2 | 1 | | | | | |
| | (e) | (e)-2 | 1 | | | 2 | | | | | |
| | | (e)-3 | | 2 | 4 | 2 | 2 | 2 | 2 | 10 | |
| | | (e)-4 | | | | | 3 | | | | 6 |
| | (f) | (f)-1 | 2 | 2 | 2 | 2 | 2 | 2 | 2 | 2 | 2 |
| | | (f)-2 | 0.5 | 2 | 2 | 0.5 | 0.5 | 0.5 | 0.5 | 2 | 0.5 |
| | | (f)-3 | 5 | 5 | 5 | 5 | 5 | 5 | 5 | 5 | 5 |
| | (g) | (g)-2 | 0.10 | | | 0.10 | 0.10 | 0.10 | 0.10 | | 0.10 |
| | | (g)-3 | 0.28 | 0.06 | 0.06 | 0.28 | 0.28 | 0.28 | 0.28 | 0.06 | 0.28 |
| | Others | Antibacterial agent | 0.10 | 0.10 | 0.10 | 0.10 | 0.10 | 0.10 | 0.10 | 0.10 | 0.10 |
| | | Dye | 0.003 | 0.003 | 0.003 | 0.003 | 0.003 | 0.003 | 0.003 | 0.003 | 0.003 |
| | | Perfume | 0.30 | 0.30 | 0.30 | 0.30 | 0.30 | 0.30 | 0.30 | 0.30 | 0.30 |
| | | Water | Balance | Balance | Balance | Balance | Balance | Balance | Balance | Balance | Balance |
| (a)/(b) (mass ratio) | | | 1.3 | 1 | 0.5 | 1 | 1.3 | 1 | 1.3 | — | — |
| Result of evaluation | Feel | Tenseness | ◎ | ○ | ○ | ○ | ○ | ○ | ○ | X X | ◎ |
| | | Starchiness | ○ | ◎ | ◎ | ◎ | ◎ | ◎ | ◎ | ◎ | X X |
| | | Smoothness | ○ | ◎ | ◎ | ◎ | ◎ | ○ | ◎ | ○ | X |
| | | Wrinkles | ◎ | ◎ | ◎ | ○ | ◎ | ○ | ○ | ○ | X |
| | | Wasing machine charge port | ○ | ○ | ○ | ○ | ○ | ○ | ○ | ○ | X |

Example 3

Using each component shown in Table 3; each fiber product treating agent composition shown in Table 3 was prepared in an amount of 150 g. At this time, a polypropylene plastic cup (volume: 200 mL) was used as a mixing container and a magnetic stirrer was used in the mixing method. First, the components (e) and (f) were weighed and mixed with each other and then, the component (a) heated to a temperature above the melting point was added to the mixture, which was then mixed further. Next, the component (b) was poured into the mixture with mixing and the resulting mixture was further mixed for about 30 minutes after the addition of the component (b) was finished. To the resulting mixture was added water, followed by mixing and the component (c) was added to the mixture. The component (d) was added with continuing mixing and other components were added, followed by adjusting the resulting mixture to a predetermined pH by using the component (g) to obtain each composition. The performances of the resulting compositions were evaluated in the following methods. The results of evaluation are shown in Table 3.

Method of Evaluation

An accumulator trigger type spray container (content: 400 mL, discharge: 1.5 to 20 g/stroke, spray pattern (area exposed to the liquid sprayed from a place 15 cm apart therefrom in a horizontal direction parallel to a subject surface (plane) disposed vertically to the ground): 150 to 400 $cm^2$) was charged with each composition in Table 3. Fiber products pre-treated in the same way as Example 1 (shirt, SALAFORD, manufactured by (k.k.) Chikuma, white, polyester/cotton: 65%/35%) were hung with a hanger to spray 60 mL of the composition of Table 3 as uniformly as possible on the surface of the clothes with keeping a distance of about 15 cm from the top of the spray to the surface of the clothes. The clothes were dried in a shade in a hanging state on a hunger for 12 hours and then evaluated as to feel to the touch and wrinkles in the same manner as in Example 1.

TABLE 3

| | | | Product of the invention | Comparative product | |
|---|---|---|---|---|---|
| | | | 1 | 1 | 2 |
| Treating agent composition (wt %) | (a) | (a)-3 | 1.5 | | |
| | (b) | (b)-2 | 0.6 | | 0.6 |
| | | (b)-3 | | 0.8 | |
| | (c) | (c)-1 | 0.1 | | 0.1 |
| | | (c)-2 | | 0.05 | |
| | (d) | (d1)-1 | | | 1.5 |
| | | (d1)-2 | 0.1 | 0.1 | 0.1 |
| | (e) | (e)-3 | 0.2 | 2.0 | 0.2 |
| | | (e)-4 | 0.3 | | 0.3 |
| | (f) | (f)-1 | 0.2 | 0.2 | 0.2 |
| | | (f)-2 | 0.5 | 0.5 | 0.5 |
| | | (f)-3 | 2.0 | 2.0 | 2.0 |
| | (g) | (g)-2 | 0.10 | | 0.10 |
| | | (g)-3 | 0.28 | 0.06 | 0.28 |
| | Others | Antibacterial agent | 0.05 | 0.05 | 0.05 |
| | | Perfume | 0.01 | 0.01 | 0.01 |
| | | Water | Balance | Balance | Balance |
| (a)/(b) (mass ratio) | | | 2.5 | — | — |

TABLE 3-continued

| | | | Product of the invention | Comparative product | |
|---|---|---|---|---|---|
| | | | 1 | 1 | 2 |
| Result of evaluation | Feel | Tenseness | ○ | X X | ○ |
| | | Starchiness | ○ | ○ | X |
| | | Smoothness | ○ | ○ | X |
| | | Wrinkles | ○ | ○ | X |

Example 4

The ingredients used in the examples and comparative examples shown in Table 4 are listed below.

Component (a)

(a)-1: Nonionic surfactant (HLB: 19.2, melting point: 60.9° C.) prepared by adding ethyleneoxide to stearyl alcohol in an amount of an average of 140 mol per 1 mol of the alcohol.

(a)-2: Nonionic surfactant (HLB: 18.7, melting point: 60.3° C.) prepared by adding ethylene oxide to Kalcol 8688 (manufactured by Kao Corporation, straight-chain primary alcohol in which the content of an alcohol having 18 carbon atoms is 87% by mass, the content of an alcohol having 16 carbon atoms is 13% by mass and the content of an alcohol having 14 carbon atoms is less than 0.1% by mass) in an amount of an average of 90 mol per 1 mol of the alcohol (a)-3: Nonionic surfactant (HLB: 19.1, melting point: 61.2° C.) prepared by adding ethylene oxide to Kalcol 8688 in an amount of an average of 130 mol per 1 mol of the alcohol.

(a)-4: Nonionic surfactant (HLB: 19.4, melting point: 61.5° C.) prepared by adding ethylene oxide to Kalcol 6870 (manufactured by Kao Corporation, straight-chain primary alcohol in which the content of an alcohol having 16 carbon atoms is 71% by mass, the content of an alcohol having 18 carbon atoms is 21% by mass, the content of an alcohol having 14 carbon atoms is 6% by mass and the content of an alcohol having 12 carbon atoms is 2% by mass) in an amount of an average of 180 mol per 1 mol of the alcohol.

Component (b)

(b)-1: KF-864 (amino-modified silicone, manufactured by Shin-Etsu Chemical Co., Ltd., viscosity: 1700 $mm^2/s$ (25° C.), amino equivalent: 3800).

(b)-2: DC2-8630 (amino-modified silicone, manufactured by Dow Corning Toray Silicone Co., Ltd., viscosity: 1500 $mm^2/s$ (25° C.), amino equivalent: 4300).

(b)-3: SF8457C (amino-modified silicone, manufactured by Dow Corning Toray Silicone Co., Ltd., viscosity: 1200 $mm^2/s$ (25° C.), amino equivalent: 1800).

Component (c)

(c)-1: Quartamin D86P (manufactured by Kao Corporation, distearyldimethylammonium chloride)

(c)-2: Quartamin 86W (manufactured by Kao Corporation, stearyltrimethylammonium chloride)

(c)-3: Dialkyl (C12-14) dimethylammonium chloride

Component (d)

(d1)-1: Poise C-60H (manufactured by Kao Corporation, cationic cellulose, molecular weight: about 600000).

(d1)-2: PVA-217 (manufactured by Kuraray Co., Ltd., partially saponified polyvinyl alcohol).

Component (d2)

(d2)-1: PEG6000 (polyethylene glycol, average molecular weight: 6000)

Component (e)

(e)-1:

(e)-2: Softanol 70 (manufactured by Nippon Shokubai Co., Ltd.).

(e)-3: Nonionic surfactant prepared by adding an average of 5 mol of ethylene oxide, an average of 2 mol of propylene oxide and an average of 3 mol of ethylene oxide in this order to a straight-chain primary alcohol having 12 to 14 carbon atoms.

Component (f)

(f)-1: Diethylene glycol monobutyl ether.

(f)-2: Ethanol.

(f)-3: Propylene glycol.

Component (g)

(g)-1: Citric acid.

(g)-2: Lactic acid.

(g)-3: Hydrochloric acid (effective component of HCl: 35%).

Other Components

Antibacterial agent: Proxel IB (manufactured by Avecia kk, aqueous 20% solution)

Dye: Violet 201

Using each component shown in Table 4, each fiber product treating agent composition shown in Table 4 was prepared in an amount of 150 g. At this time, a polypropylene plastic cup (volume: 200 mL) was used as a mixing container and a magnetic stirrer was used in the mixing method. First, the components (e) and (f) were weighed and mixed with each other and then, the component (a) heated to a temperature above the melting point was added to the mixture, which was then mixed further. Water was added to the resulting mixture in an amount corresponding to 10% by mass of all the composition, followed by further mixing. Next, the component (b) was poured into the mixture at a rate of 2 g/min. in a predetermined amount with mixing and the resulting mixture was further mixed for about 30 minutes after the addition of the component (b) was finished. To the resulting mixture was added the remainder of the water to be compounded, followed by mixing and the component (c) was added to the mixture. The component (d) was added with continuing mixing and other components were added, followed by adjusting the resulting mixture to a predetermined pH by using the component (g) to obtain each composition. The performances of the resulting compositions were evaluated in the following methods. The results of evaluation are shown in Table 4.

Pretreatment of Fiber Products for Evaluation

As clothes for evaluation, one new cut-sew (manufactured by (k.k.) Chikuma, 9 to 5, beige, cotton/polyester=50/50%) and one new shirt (BLUE RIVER, white, cotton: 100%, manufactured by Flex Japan Co., Ltd., shape stability processed shirt (SSP)) were prepared and 0.9 kg of an undershirt (cotton: 100%) and 0.6 kg of a shirt (white, cotton/polyester=60/40%) were added as weight adjusting clothes to these clothes. A total amount of 1.8 kg of these clothes was washed repeatedly 10 times using a commercially available weak-alkaline detergent (Attack, manufactured by Kao Corporation) in a twin-tub type washing machine (Toshiba Ginga VH-360S1) (detergent concentration: 0.0667% by mass, using 36 L (20° C.) of tap water, washing (10 minutes)-dewatering (3 minutes)-rinsing (8 minutes) (rinsing in water stream, amount of water: 15 L/min.)). The flow of water was stopped 5 minutes after the final rinsing process (10th time) was started, the washed water was drained off and then the shirt was dewatered for 3 minutes. Then, 36 L of tap water (20° C.) was poured into the washing machine and 23.33 g of each treating agent composition of Table 4 was poured, followed by stirring treatment carried out for 3 minutes. After the stirring was stopped, these clothes were dewatered for 3 minutes and the cut-sew and the shape stability processed shirt were taken out as clothes for evaluation. The clothes for evaluation were hung on a hunger out of the sun to dry these clothes in a hanging condition for 12 hours. The dried clothes were evaluated as to feel to the touch and wrinkles in the following methods. The cut-sew and the shape stability processed shirt were both evaluated in contrast with the control and the both had the same tendencies. The results of the shape stability processed shirt are shown in Table 4. Also, each treating agent composition was evaluated as to a charge port of the washing machine by the following method.

Method of Evaluation of Feel to the Touch

A fiber product that was humidity-conditioned for 24 hours in a 25° C.-65 RH thermohygrostat after it was treated by each treating agent composition and hung for 12 hours to dry was evaluated as to softness, tenseness, starchiness, and smoothness by five panelists who kept a record of points based on the following standard to calculate an average of the points of the panelists. In this case, a fiber product which was treated only by tap water without using any treating agent and was likewise humidity-conditioned in a 25° C.-65 RH thermohygrostat after it was pretreated was used as a control. Each sample was judged based on the following standard: ⊙: the average exceeds 1.0 and 2.0 or less, ○: the average exceeds 0 and 1.0 or less, Δ: the average is 0, x: the average is −1.0 or more and less than 0 and xx: the average is −2.0 or more and less than −1.0.

Softness
The control is softer: +2 point
The control is slightly softer: +1 point
The same as the control: 0 point
Slightly softer than the control: −1 point
Softer than the control: −2 point Tenseness
Tenser than the control: +2 point
Slightly tenser than the control: +1 point
The same as the control: 0 point
The control is slightly tenser: −1 point
The control is tenser: −2 point Starchiness
The control is more starchy: +2 point
The control is slightly more starchy: +1 point
The same as the control: 0 point
Slightly more starchy than the control: −1 point
More starchy than the control: −2 point Smoothness
Smoother than the control: +2 point
Slightly smoother than the control: +1 point
The same as the control: 0 point
The control is slightly smoother: −1 point
The control is smoother: −2 point Method of Evaluation of Wrinkles A fiber product that was treated by each treating agent composition and hung for 12 hours to dry was evaluated by five panelists who kept a record of points based on the following standard to calculate an average of the points of the panelists. In this case, a fiber product which was treated only by tap water without using any treating agent and was likewise dried after it was pretreated was used as a control. Each sample was judged based on the following standard: ⊙: the average exceeds 1.0 and 2.0 or less, ○: the average exceeds 0 and 1.0 or less, Δ: the average is 0, x: the average is −1.0 or more and less than 0 and xx the average is −2.0 or more and less than −1.0.

Wrinkles
More reduced in wrinkles than the control: +2 point
A slightly reduced in wrinkles than the control: +1 point
The same as the control: 0 point
The control is slightly reduced in wrinkles: −1 point
The control is more reduced in wrinkles: −2 point Method of Evaluation as to a Charge Port of a Washing Machine Using a automatic washing machine (National Three-stage Washing Method NAF80SP1) provided with a tray style softener charge port, the condition of the inside of the charge port in cumulative use (general course, 20° C. tap water, the amount of water passing through the charge port: about 1 L, each treating agent: 40 g/time, accumulation of five times (once daily)) was observed and evaluated according to the following standard.

No adsorbed substance is observed both on the inside wall of the charge port and at the liquid discharge port: ○

Adsorbed substances are observed on the inside wall of the charge port or at the liquid discharge port: Δ

Adsorbed substance are observed both on the inside wall of the charge port and at the liquid discharge port: x Evaluation of Storage Stability 25 g of each treating composition was placed in a glass screw tube (No. 6, 30 mm×65 mm) having a capacity of 30 mL and sealed hermetically under an atmospheric pressure (two tubes each). These two tubes were stored in 5° C. and 50° C. thermostatic chambers for 20 days such that the lid faces upward to measure the Klett number (absorbance at 420 nm×1000) by an absorptiometer. A difference in Klett number between the product stored at 5° C. and the product stored at 50° C. to evaluate according to the following standard.

The difference in Klett number is 0 or more and less than 50: ○

The difference in Klett number is 50 or more and less than 100: Δ

The difference in Klett number is 100 or more: x

TABLE 4

| | Ingredients | Example 4 | | | | | Comparative example | |
|---|---|---|---|---|---|---|---|---|
| | (wt %) | 4-1 | 4-2 | 4-3 | 4-4 | 4-5 | 4-6 | 4-7 |
| (a) | (a)-1 | 8 | | | | | | |
| | (a)-2 | | 8 | | 4 | | | |
| | (a)-3 | | | 8 | | | 8 | |
| | (a)-4 | | | | 4 | 8 | | |
| (b) | (b)-1 | 6 | 6 | | | 4 | | |
| | (b)-2 | | | 4 | 4 | 2 | | |
| | (b)-3 | | | | | | 6 | 4 |

TABLE 4-continued

| | Ingredients | Example 4 | | | | | Comparative example | |
|---|---|---|---|---|---|---|---|---|
| | (wt %) | 4-1 | 4-2 | 4-3 | 4-4 | 4-5 | 4-6 | 4-7 |
| (c) | (c)-1 | | | | 1 | | | |
| | (c)-2 | | | 1 | | | | |
| | (c)-3 | 4 | 2 | 3 | 3 | 1 | 2 | 3 |
| (d) | (d1)-1 | 0.05 | | | | | | |
| | (d1)-2 | | 0.5 | | | 0.5 | 0.5 | |
| | (d2)-1 | 1 | 1 | 1 | 1 | 1 | 1 | 1 |
| (e) | (e)-1 | 1.5 | 1 | 2 | | 2 | 1 | 2 |
| | (e)-2 | | 1 | | 2 | | 1 | |
| | (e)-3 | 1.5 | 2 | 1 | 2 | 2 | 2 | 1 |
| (f) | (f)-1 | 5 | 5 | 5 | 5 | 5 | 5 | 5 |
| | (f)-2 | 0.8 | 0.8 | 0.8 | 0.8 | 0.8 | 0.8 | 0.8 |
| | (f)-3 | 2 | 2 | 2 | 2 | 2 | 2 | 2 |
| (g) | (g)-1 | 0.05 | 0.05 | 0.05 | 0.05 | 0.05 | 0.05 | 0.05 |
| | (g)-2 | 0.02 | 0.02 | 0.02 | 0.02 | 0.02 | 0.02 | 0.02 |
| | (g)-3 | Amount adjusting to pH 4.0 | | | | | | |
| Others | Antibacterial agent | 0.10 | 0.10 | 0.10 | 0.10 | 0.10 | 0.10 | 0.10 |
| | Chelating agent | 0.015 | 0.015 | 0.015 | 0.015 | 0.015 | 0.015 | 0.015 |
| | Dye | 0.003 | 0.003 | 0.003 | 0.003 | 0.003 | 0.003 | 0.003 |
| | Perfume | 0.40 | 0.40 | 0.40 | 0.40 | 0.40 | 0.40 | 0.40 |
| | Water | Balance | Balance | Balance | Balance | Balance | Balance | Balance |
| | Tenseness | ◎ | ○ | ◎ | ○ | ◎ | ○ | X |
| | Starchiness | ◎ | ◎ | ◎ | ◎ | ◎ | ◎ | ◎ |
| | Smoothness | ◎ | ◎ | ○ | ○ | ◎ | ◎ | ◎ |
| | Wrinkles | ◎ | ◎ | ◎ | ◎ | ◎ | ○ | X |
| | Washing machine charge port | ○ | ○ | ○ | ○ | ○ | ○ | ○ |
| | Strorage stability | ○ | ○ | ○ | ○ | ○ | X | X |

The following is examples of compositions containing the components (a), (b) and (m). The ingredients used in the examples are listed below.

Component (a)

(a)-1: Nonionic surfactant (HLB: 18.5, melting point: 54.9° C.) prepared by adding ethylene oxide to Kalcol 8688 (manufactured by Kao Corporation, straight-chain primary alcohol in which the content of an alcohol having 18 carbon atoms is 87% by mass, the content of an alcohol having 16 carbon atoms is 13% by mass and the content of an alcohol having 14 carbon atoms is less than 0.1% by mass) in an amount of an average of 75 mol per 1 mol of the alcohol (a)-2: Nonionic surfactant (HLB: 19.1, melting point: 61.2° C.) prepared by adding ethylene oxide to Kalcol 8688 in an amount of an average of 125 mol per 1 mol of the alcohol.

(a)-3: Nonionic surfactant (HLB: 19.3, melting point: 61.3° C.) prepared by adding ethylene oxide to Kalcol 8688 in an amount of an average of 150 mol per 1 mol of the alcohol.

Component (b)

(b)-1: TSF4707 (amino-modified silicone, manufactured by GE Toshiba Silicones, viscosity: 10000 $mm^2/s$, amino equivalent: 7000)

(b)-2: KF-864 (amino-modified silicone, manufactured by Shin-Etsu Chemical Co., Ltd., viscosity: 1700 $mm^2/s$ (25° C.) amino equivalent: 3800).

(b)-3: DC2-8630 (amino-modified silicone, manufactured by Dow Corning Toray Silicone Co., Ltd., viscosity: 1500 $mm^2/s$ (25° C.) amino equivalent: 4300).

Component (m)

(m)-1: Silicone compound represented by the formula (2), wherein x is a number of 300, y is a number of 7, z is a number of 4, $R^{11}$ and $R^{12}$ are respectively a methyl group, D is a mixture of the groups represented by (i) $—(CH_2)_3—NH—CO—CH_2—O—(CH_2CH_2O)_5—C_{12}H_{25}$ and (ii) $—(CH_2)_3—NH_2$ [(i)/(ii)=7/3 (molar ratio)] and E is a group represented by $—(CH_2)_3—O—CH_2CH_2O)_{10}—CH_3$.

(m)-2: FZ2203 (manufactured by Nippon Unicar Company Limited).

(m)-3: KF6012 (manufactured by Shin-Etsu Chemical Co., Ltd.).

Component (c)

(c)-1: Dialkyl (C12-14) dimethylammonium chloride (c)-2: Quartamin 86W (manufactured by Kao Corporation, stearyltrimethylammonium chloride)

Component (d1)

(d1)-1: Poise C-60H (manufactured by Kao Corporation, cationic cellulose, molecular weight: about 600000).

(d1)-2: PVA-217 (manufactured by Kuraray Co., Ltd., partially saponified polyvinyl alcohol).

Component (d2)

(d2)-1: PEG6000 (polyethylene glycol, average molecular weight: 6000)

(d2)-2: PEG13000 (polyethylene glycol, average molecular weight: 13000)

Component (e)

(e)-1: Softanol 30 (manufactured by Nippon Shokubai Co., Ltd., one obtained by adding ethylene oxide to a C12-14 secondary alcohol in an amount of an average of 3 mol).

(e)-2: Nonionic surfactant prepared by adding an average of 5 mol of ethylene oxide, an average of 2 mol of propylene oxide and an average of 3 mol of ethylene oxide in this order to a straight-chain primary alcohol having 12 to 14 carbon atoms.

Component (f)

(f)-1: Diethylene glycol monobutyl ether.

(f)-2: Ethanol.

(f)-3: Dipropylene glycol.

(f)-4: Propylene glycol.

Component (h)

(h)-1: Lactic acid.

(h)-2: Hydrochloric acid (effective component of HCl: 20%).

Other Components

Antibacterial agent: Proxel IB (manufactured by Avecia kk, aqueous 20% solution)

Dye: Violet 401

Examples 11 to 15 and Comparative Examples 11 and 12

Each component shown in Table 5 was dissolved in 5 L of tap water in each proportion shown in Table 5 to obtain fiber product treating agent compositions. The water absorbing property of the obtained composition was evaluated in the following method. The results are shown in Table 5.

Method of Evaluation of Water Absorbing Property

1) Pretreatment of Fiber Products for Evaluation 24 white towels (T.W220, manufactured by Takei Towel (k.k.) were prepared and washed repeatedly 5 times using a commercially available weak-alkaline detergent (Attack, manufactured by Kao Corporation) in a automatic washing machine (National Na-F55A2) (detergent concentration: 0.0667% by mass, using 48 L (20° C.) of tap water, washing (10 minutes)-water filling rinsing (once)-dewatering (3 minutes)). After the final treating cycle was finished, the towels were washed further twice without using any detergent (using 48 L (20° C.) of tap water, washing (10 minutes)-water filling rinsing (twice)-dewatering (3 minutes)). The final treating cycle was finished, the towels were dried naturally in a room in a hanging condition to prepare fiber products for evaluation (pretreated).

16 undershirts (YG, manufactured by Gunze Ltd., cotton: 100%) were prepared and washed repeatedly 10 times using a commercially available weak-alkaline detergent (Attack, manufactured by Kao Corporation) in a twin-tub type washing machine (Toshiba Ginga VH-360S1) (detergent concentration: 0.0667% by mass, using 40 L (20° C.) of tap water, washing (10 minutes)-dewatering (3 minutes)-rinsing (8 minutes) (rinsing in water stream, amount of water: 15 L/min.)). After the rinsing in the final treating cycle was finished, these undershirts were dewatered for 5 minutes and air-dried in a room in a hanging condition to prepare fiber products for evaluation (pretreated).

2) Treatment Using a Model Washing Machine

The two pretreated towels and one pretreated undershirts were weighed and placed in an electric bucket (National N-BK2) together with tap water (20° C.) weighed such that the bath ratio was 20. A commercially available weak-alkaline detergent (Attack, manufactured by Kao Corporation) was poured into the bucket in an amount weighed such that the detergent concentration was 0.667% by mass to carry out washing (6 minutes). Next, these clothes were dewatered in a dewatering tank of a twin-tub type washing machine (Toshiba Ginga VH-360S1). Next, these clothes were rinsed (3 minutes) with water reserved in the electric bucket and then each treating agent composition shown in Table 5 was poured into the bucket in an amount weighed such that the concentration of the composition was 0.167% by mass, followed by stirring for 3 minutes. After the stirring was stopped, the clothes were dewatered using the dewatering tank of the twin-tub washing machine for one minute and air-dried in a 25° C.-65% RH thermohygrostat in a hanging state to prepare a fiber product for evaluation (finally treated).

3) Evaluation of Water Absorptive Ability (Bireck Method)

Each plain weave part of the above towels and undershirt finally treated was cut into a band form of 2 cm×25 cm, which was then subjected to the evaluation of water absorptive ability according to the Bireck method. The water absorptive ability was measured in 25° C.-65% RH thermohygrostat. The top end of the band cloth was fixed to hang the cloth in a vertical direction and soaked in water to record the time (min.) taken since the lower end of the band cloth sunk to a depth of 1 cm below the surface of the water kept at 25° C. and to visually observe and record the height (cm) of water absorbed in the band cloth by a capillary phenomenon.

The height of water absorbed in the band cloth one minute after the band cloth was soaked in water was compared with an untreated band cloth (the same treatment as above was carried out without using any treating agent) and judged according to according to the following standard.

x: Water-absorption height (one minute later) is less than 10% of that of the untreated product.

Δ: Water-absorption height (one minute later) is 10% or more and less than 20% of that of the untreated product.

∇: Water-absorption height (one minute later) is 20% or more and less than 30% of that of the untreated product.

○: Water-absorption height (one minute later) is 30% or more and less than 50% of that of the untreated product.

⊙: Water-absorption height (one minute later) is 50% or more of that of the untreated product.

The invention claimed is:

1. A fiber product treating agent composition comprising (a) a nonionic surfactant containing 1 to 3 polyoxyalkylene groups having the number-average addition mol number of the oxyalkylene group of 50 to 200 and 1 to 3 hydrocarbon groups having 14 to 32 carbon atoms and having an HLB of 16 or more and a melting point of 30 to 80° C., (b) an amino-modified silicone compound, (c) at least one type selected from a tertiary amine in which one or two groups of the three groups bonded to a nitrogen atom of the tertiary amine is/are a hydrocarbon group having 10 to 20 carbon atoms and the remainder group(s) is/are a hydrocarbon group which has 1 to 3 carbon atoms and may be substituted with a hydroxy group, an acid salt thereof and a quaternary product thereof, and (d) polymer compound having the weight-average molecular weight of 2000 or more (excluding component (a) and component (b)), at a mass ratio of the component (a)/the component (b) of 4/1 to 1/4, at a mass ratio of the component (a)/the component (c) of 20/1 to 1/1, at a mass ratio of [the component (a)+component (b)]/[component (c)+component (d)] of 95/5 to 80/20.

2. The fiber product treating agent composition according to claim 1, wherein the component (a) is a compound represented by the, formula (1):

$$R^{1a}\text{-A-}[(R^{1b}\text{—O})_a\text{—}R^{1c}]_b \quad (1)$$

wherein $R^{1a}$ represents an alkyl or alkenyl group having 14 to 32, $R^{1b}$ represents an alkylene group having 2 or 3 carbon atoms, $R^{1c}$ represents a group selected from a hydrogen atom, an alkyl or alkenyl group having 14 to 32, or an alkanoyl or alkenoyl group having 15 to 33 carbon atoms, A represents a connecting group selected from —O—, —COO—, —CON< or —N<, provided that when A is —O— or —COO—, b is 1 or when A is —CON< or —N<, b is 2, a is a number-average value of 50 to 200, where plural $R^{1b}$s and $R^{1c}$s may be the same or different.

3. The fiber product treating agent composition according to claim 1 or claim 2, wherein the component (b) is a compound having a kinematic viscosity of 100 to 20000 $mm^2/s$ at 25° C. and an amino equivalence of 400 to 8000.

4. The fiber product treating agent composition according to claim 1, further comprising (m) a silicone compound having a polyoxyalkylene chain.

5. The fiber product treating agent composition according to claim 4, wherein the component (m) is a compound represented by the formula (6):

(6)

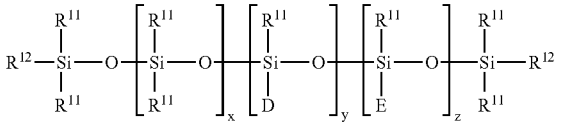

wherein x denotes a number from 100 to 600 and is given by the following equations in relation to y and z, which are respectively a number given by the following equation: x:y=100:1 to 10:1 and y:z=1:10 to 10:1, plural $R^{11}$s, which maybe the same or different, respectively represents an alkyl group having 1 to 4 carbon atoms, two $R^{12}$s, which may be the same or different, respectively represent an alkyl group having 1 to 4 carbon atoms, a hydroxyalkyl group or an alkoxy group, D is a group represented by the following formula (i) or a mixture of a group represented by the formula (i) and a group represented by the formula (ii), wherein in the latter case, the proportion of the group represented by the formula (ii) in D is 50 mol % or less;

(i)

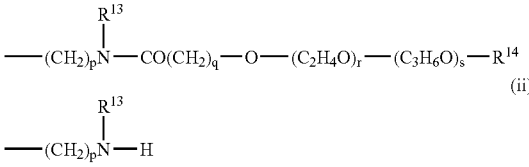

(ii)

wherein p denotes a number from 2 to 6, $R^{13}$ represents a hydrogen atom or an alkyl group having 1 to 4 carbon atoms, q denotes a number from 1 to 6, r denotes a number from 1 to 20, s denotes a number from 0 to 20, $R^{14}$ represents an alkyl group having 1 to 18 carbon atoms, where the oxyethylene group and the oxypropylene group may be bonded by either random addition or block addition, E represents a group represented by the formula (iii) or an alkyl group having 1 to 4 carbon atoms:

$$—(CH_2)_t—O—(C_2H_4O)_u—(C_3H_6O)_v—R^{15} \quad \text{(iii)}$$

wherein $R^{15}$ represents an alkyl group having 1 to 20 carbon atoms, t denotes a number from 2 to 6, u denotes a number from 1 to 20 and v denotes a number from 0 to 20, where the oxyethylene group and the oxypropylene group may be bonded by either random addition or block addition.

6. A method of treating a fiber product by applying the composition as claimed in claim 1 or 4 to the fiber product.

7. The fiber product treating agent composition according to claim 1, wherein the component (d) is a at least one selected from the group consisting of carboxymethyl cellulose, carboxyethyl cellulose, hydroxyethyl cellulose, hydroxypropyl cellulose, methyl cellulose, ethyl cellulose, sodium carboxymethyl cellulose, cationic cellulose, polyvinyl alcohol, polyvinyl alcohol maleic acid copolymer, polymethylmethacrylic acid, polyacrylic acid, sodium polyacrylate, a copolymer of vinyl acetate and acrylic acid, a copolymer of vinyl acetate and methacrylic acid, a copolymer of vinyl acetate and maleic acid, sodium polystyrenesulfonate, polyvinylpyrrolidone, polyacrylamide, water-soluble nylon, polyethylene oxide, alginic acid, sodium alginate, cornstarch, amylose, dextrin, wheat starch, potato starch, tapioca starch, alpha-starch, acid-treated starch, starch oxide, starch acetate, carboxymethyl starch, carboxyethyl starch, hydroxyethyl starch, hydroxypropyl starch, starch phosphate, cationic starch, amphoteric starch, dialdehyde starch, crosslinked starch, starch organic acid ester, starch inorganic acid ester, pluran, xanthane gum, deacetylated xanthane gum, polypropylene glycol, a copolymer of polyethylene glycol and polypropylene glycol, polydimethylsilicone, polyalkylene oxide-modified polydimethylsilicone which is a liquid at normal temperature, polyethyleneimine, polyethylene oxide adduct of polyethyleneimine, polyglycerin, polyalkylene oxide adduct of polyglycerin which is a liquid at normal temperature, and polyalkylene oxide adduct of ethylenediamine which is a liquid at normal temperature.

8. The fiber product treating agent composition according to claim 1, wherein the component (d) is at least one compound selected from the group consisting of carboxymethyl cellulose, carboxyethyl cellulose, hydroxyethyl cellulose, hydroxypropyl cellulose, methyl cellulose, ethyl cellulose, sodium carboxymethyl cellulose, cationic cellulose and polyvinyl alcohol.

9. The fiber product treating agent composition according to claim 1, wherein the composition comprises 1 to 60 percent by mass of the component (a).

10. The fiber product treating agent composition according to claim 9, wherein the component (a) is a compound represented by the formula (1):

$$R^{1a}\text{-A-}[(R^{1b}—O)_a—R^{1c}]_b \quad (1)$$

wherein $R^{1a}$ represents an alkyl or alkenyl group having 14 to 32, $R^{1b}$ represents an alkylene group having 2 or 3 carbon atoms, $R^{1c}$ represents a group selected from a hydrogen atom, an alkyl or alkenyl group having 14 to 32, or an alkanoyl or alkenoyl group having 15 to 33 carbon atoms, A represents a connecting group selected from —O—, —COO—, —CON< or —N<, provided that when A is —O— or —COO—, b is 1 or when A is —CON< or —N<, b is 2, a is a number-average value of 50 to 200, where plural $R^{1b}$s and $R^{1c}$s may be the same or different.

11. The fiber product treating agent composition according to claim 9, wherein the component (b) is a compound having a kinematic viscosity of 100 to 20000 $mm^2/s$ at 25° C. and an amino equivalence of 400 to 8000.

12. The fiber product treating agent composition according to claim 9, further comprising (m) a silicone compound having a polyoxyalkylene chain.

13. The fiber product treating agent composition according to claim 12, wherein the component (m) is a compound represented by the formula (6):

(6)

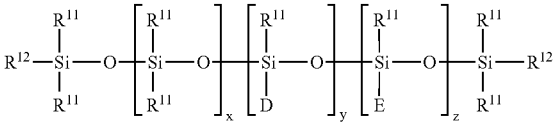

wherein x denotes a number from 100 to 600 and is given by the following equations in relation to y and z, which are respectively a number given by the following equation:

x:y=100:1 to 10:1 and y:z=1:10 to 10:1, plural $R^{11}$s, which may be the same or different, respectively represents an alkyl group having 1 to 4 carbon atoms, two $R^{12}$s, which may be the same or different, respectively represent an alkyl group having 1 to 4 carbon atoms, a hydroxyalkyl group or an alkoxy group, D is a group represented by the following formula (i) or a mixture of a group represented by the formula (i) and a group represented by the formula (ii), wherein in the latter case, the proportion of the group represented by the formula (ii) in D is 50 mol % or less;

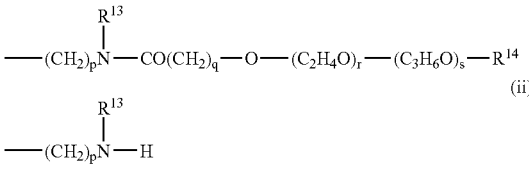

(i)

(ii)

wherein p denotes a number from 2 to 6, $R^{13}$ represents a hydrogen atom or an alkyl group having 1 to 4 carbon atoms, q denotes a number from 1 to 6, r denotes a number from 1 to 20, s denotes a number from 0 to 20, $R^{14}$ represents an alkyl group having 1 to 18 carbon atoms, where the oxyethylene group and the oxypropylene group may be bonded by either random addition or block addition, E represents a group represented by the formula (iii) or an alkyl group having 1 to 4 carbon atoms:

$$—(CH_2)_t—O—(C_2H_4O)_u—(C_3H_6O)_v—R^{15} \quad \text{(iii)}$$

wherein $R^{15}$ represents an alkyl group having 1 to 20 carbon atoms, t denotes a number from 2 to 6, u denotes a number from 1 to 20 and v denotes a number from 0 to 20, where the oxyethylene group and the oxypropylene group may be bonded by either random addition or block addition.

14. The fiber product treating agent composition according to claim 9, wherein the component (d) is a at least one selected from the group consisting of carboxymethyl cellulose, carboxyethyl cellulose, hydroxyethyl cellulose, hydroxypropyl cellulose, methyl cellulose, ethyl cellulose, sodium carboxymethyl cellulose, cationic cellulose, polyvinyl alcohol, polyvinyl alcohol maleic acid copolymer, polymethylmethacrylic acid, polyacrylic acid, sodium polyacrylate, a copolymer of vinyl acetate and acrylic acid, a copolymer of vinyl acetate and methacrylic acid, a copolymer of vinyl acetate and maleic acid, sodium polystyrenesulfonate, polyvinylpyrrolidone, polyacrylamide, water-soluble nylon, polyethylene oxide, alginic acid, sodium alginate, cornstarch, amylose, dextrin, wheat starch, potato starch, tapioca starch, alpha-starch, acid-treated starch, starch oxide, starch acetate, carboxymethyl starch, carboxyethyl starch, hydroxyethyl starch, hydroxypropyl starch, starch phosphate, cationic starch, amphoteric starch, dialdehyde starch, crosslinked starch, starch organic acid ester, starch inorganic acid ester, pluran, xanthane gum, deacetylated xanthane gum, polypropylene glycol, a copolymer of polyethylene glycol and polypropylene glycol, polydimethylsilicone, polyalkylene oxide-modified polydimethylsilicone which is a liquid at normal temperature, polyethyleneimine, polyethylene oxide adduct of polyethyleneimine, polyglycerin, polyalkylene oxide adduct of polyglycerin which is a liquid at normal temperature, and polyalkylene oxide adduct of ethylenediamine which is a liquid at normal temperature.

15. The fiber product treating agent composition according to claim 9, wherein the component (d) is at least one compound selected from the group consisting of carboxymethyl cellulose, carboxyethyl cellulose, hydroxyethyl cellulose, hydroxypropyl cellulose, methyl cellulose, ethyl cellulose, sodium carboxymethyl cellulose, cationic cellulose and polyvinyl alcohol.

16. A method of treating a fiber product by applying the composition as claimed in claim 9 or 12 to the fiber product.

17. The method of treating a fiber product, according to claim 6, wherein the composition is applied to the fiber product in a rinsing stage.

18. The method of treating a fiber product according to claim 6, comprising diluting the composition to a point where component (a) is in a concentration of 20 to 1000 ppm and wherein the diluted composition is applied to the fiber product.

19. The method of treating a fiber product according to claim 6, wherein the composition is applied to the fiber product by spraying.

20. The method of treating a fiber product according to claim 16, wherein the composition is applied to the fiber product in a rinsing stage.

21. The method of treating a fiber product according to claim 16, comprising diluting the composition to a point where component (a) is in a concentration of 20 to 1000 ppm and wherein the diluted composition is applied to the fiber product.

22. The method of treating a fiber product according to claim 16, wherein the composition is applied to the fiber product by spraying.

* * * * *